US012729591B2

(12) United States Patent
Garcia Soule et al.

(10) Patent No.: US 12,729,591 B2
(45) **Date of Patent: *Sep. 8, 2026**

(54) METHOD AND APPARATUS FOR AUTOMATIC DRILL OUT

(71) Applicant: TETRA Technologies, Inc., The Woodlands, TX (US)

(72) Inventors: Virgilio Garcia Soule, Cypress, TX (US); James Matthew Watson, Palestine, TX (US); Brandon Scott Mitchell, Cranberry Township, PA (US); Travis Martin Bahrt, Cochranton, PA (US)

(73) Assignee: TETRA Technologies, Inc., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/081,697

(22) Filed: Mar. 17, 2025

(65) Prior Publication Data

US 2025/0277416 A1 Sep. 4, 2025

Related U.S. Application Data

(63) Continuation of application No. 18/386,307, filed on Nov. 2, 2023, now Pat. No. 12,252,943.

(60) Provisional application No. 63/426,923, filed on Nov. 21, 2022.

(51) Int. Cl.
*E21B 21/06* (2006.01)
*E21B 21/10* (2006.01)

(52) U.S. Cl.
CPC ..... *E21B 21/065* (2013.01); *E21B 21/06* (2013.01); *E21B 21/063* (2013.01); *E21B 21/106* (2013.01)

(58) Field of Classification Search
CPC ..... E21B 7/022; E21B 7/026; E21B 21/0135; E21B 27/005; E21B 34/045; E21B 34/066; E21B 2200/20; E21B 21/106; E21B 21/065; E21B 21/06; E21B 21/063
See application file for complete search history.

(56) References Cited

U.S. PATENT DOCUMENTS

| | | | | |
|---|---|---|---|---|
| 8,127,867 | B1 * | 3/2012 | Droke | E21B 21/065 166/267 |
| 12,252,943 | B2 * | 3/2025 | Garcia Soule | E21B 21/063 |
| 2016/0376859 | A1 * | 12/2016 | Mehrabian | E21B 44/00 175/25 |
| 2021/0140252 | A1 * | 5/2021 | Biggerstaff | B07B 1/18 |

* cited by examiner

*Primary Examiner* — Brad Harcourt
(74) *Attorney, Agent, or Firm* — Roy Kiesel Ford Doody & North, APLC; Brett A. North

(57) ABSTRACT

An improved debris catcher and choke system for receiving a pressurized fluid stream from wellbore operations where a controller can selectively place a plurality of debris catchers in debris catching or flushing modes, and the cleaned fluids from one of the debris catchers can be used to flush one of the other debris catchers. One or more embodiments relate to systems and methods for utilizing debris catchers and choke valves.

17 Claims, 12 Drawing Sheets

METHOD AND APPARATUS FOR AUTOMATIC DRILL OUT

CROSS-REFERENCE TO RELATED APPLICATIONS

This is a continuation of U.S. patent application Ser. No. 18/386,307, filed Nov. 2, 2023 (issuing as U.S. Pat. No. 12,252,943 on Mar. 18, 2025), which claims the benefit of U.S. provisional patent application Ser. No. 63/426,923, filed on Nov. 21, 2022, priority of each of such above referenced application(s) and patent(s) is hereby claimed and each of such application(s) and patent(s) is incorporated herein by reference in its entirety.

BACKGROUND OF THE INVENTION

Conventional well operation fluid treatment systems use a debris catcher located on a skid to treat fluids from well operations, and where a choke manifold on a separate skid is located downstream of the debris catcher skid. Both skids need to be position at specific distances and connected via pipes to perform in well operations pipelines. Over time, fluid passing through the debris catcher, will cause solids and debris to accumulate in the debris catcher, and such solids/debris must be removed.

Removal of accumulated solids/debris from the debris catcher can be performed by manually: (a) isolating the debris catcher via opening and closing valves thereby isolating flow away from the debris catcher; (b) removing a cleaning cap from the debris catcher; (c) removing a debris catching screen from the debris catcher; and (d) physically removing the accumulated/captured solids/debris from the debris catching screen. Alternatively, external "flush pumps" can be connected to the debris catcher to pump an external flushing fluid through the debris catcher to remove the accumulated/captured solids/debris, but this process requires additional equipment, a flushing pump, and valves.

The above prior art method is time consuming and increases health, safety, and environmental ("HSE") risks associated with rig-up operations.

One or more embodiments of the invention avoid a need to:

(a) install interconnecting pipelines between the debris catcher and the choke manifold skids;

(b) incorporate external pumps to flush the debris vessel; and/or (c) manually removing solids from the vessel.

Various embodiments reduce or eliminate personnel exposure and HSE risks during high pressure flow operations by means of remote actuation of valves through a PLC control panel so that personnel are no longer required to manually open and close valves.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

SUMMARY OF THE INVENTION

In one embodiment is provided a method and apparatus for catching debris from a fluid source wherein the apparatus includes a "self-cleaning" debris catcher system, which includes a plurality of debris catchers that can be selectively placed in a debris catching mode or in a cleaning/flushing mode, wherein the system uses the pressure from the fluid source being cleaned to both: (i) catch debris using the debris catcher(s) in the debris catching mode and (ii) clean/flush the debris catcher(s) in the cleaning/flushing mode.

In various embodiments the debris catchers can be strainers.

In one embodiment, when in a debris catching mode, fluid enters the debris catcher via an inlet and exits the debris catcher via a first outlet, and when in the cleaning/flushing mode, fluid enters the debris catcher via the inlet and exits the debris catcher via a second outlet that is different from the first outlet. In one embodiment when in the debris catching mode, fluid enters the debris catcher via the inlet, passes through a screen (allowing fluid to pass through but blocking at least a portion of debris and/or solids contained in the fluid), and exits via the first outlet. In one embodiment when in the cleaning/flushing mode, fluid enters the debris catcher via the inlet and exits via first outlet while carrying accumulated solids and debris with the fluid.

In one embodiment, when in a debris catching mode, fluid generally flows through the debris catcher a first longitudinal distance across the debris catcher, and when in the flushing/cleaning mode, fluid generally flows through the debris catcher a second longitudinal distance across the debris catcher, the second longitudinal distance being greater than the first longitudinal distance.

In one embodiment the debris catcher can have a tubular housing with an interior bore. In one embodiment the interior bore can be cylindrical.

In one embodiment, the debris catcher can have a cylindrical screen positioned in the interior bore. In one embodiment the cylindrical screen can have an interior bore and a cylindrical side wall having a plurality of perforations or openings to block solids or debris which is larger than the side of the perforations or openings.

In one embodiment, the debris catcher can have an inlet and first and second outlets, wherein, in the debris catching mode fluid enters from the inlet and exits from the first outlet, and in the cleaning mode, fluid enters from the inlet and exits from the second outlet.

In one embodiment the debris catcher catches debris flowing through the debris catcher in a first direction and simultaneous flushing of one of the dual debris catchers while the other debris catcher is operating to catch debris.

In various embodiments, after installation of the method and apparatus in a fluid stream to be treated, the pressure/power of the fluid being treated by a debris catcher is used to power both the removal by the debris catcher of solids/debris in the fluid along with "flushing" of accumulated/captured solids/debris from the debris catcher, and further avoids the requirement of installing or hooking up additional pumps and/or fluid lines when switching a debris catcher between a debris catching mode and a flushing/cleaning mode.

In various embodiments a debris catching system and a pressure regulating system are integrated into a single portable skid where the pressure/power of the fluid being treated by the debris catching system is used to both power: (a) the removal of solids/debris by the debris catching system and (b) "flushing"/cleaning of accumulated/captured solids/debris from the debris catching system. In various embodiments a portion of the fluid cleaned by a first debris catcher in the debris catching system is used to flush/clean a accumulated debris/solids in a second debris catcher in the debris catching system.

In various embodiments a controller controls fluid flow to the debris catching system including to both: (a) a first debris catcher in a debris catching mode and (b) a second debris catcher in a flushing/cleaning mode, and automatically changes the states of the first and/or second debris catchers between a debris catching mode and a flushing/cleaning mode based on predefined parameters. In one embodiment one of the predefined parameters can be based on feedback or signals received from the debris catcher in the debris catching mode such as resistance to flow through this debris catcher, flow rate, volume of flow, and/or time of flow. In one embodiment one of the predefined parameters can be based on feedback received from the debris catcher in the flushing/cleaning mode such as resistance to flow through this debris catcher, flow rate, volume of flow, and/or time of flow.

In various embodiments of the method and apparatus includes the integration of multiple functions into a single skid, significantly reducing rig up time, and/or HSE exposure of personnel to high pressure equipment. In one embodiment is provided a method and apparatus for an integrated debris/solids catching with pressure and flow control, and integrated flushing of debris/solids capability.

In various embodiments the method and apparatus can have a plurality of valves controlled by a controller which can control valve actuation and sequence protocol to flow, diverting flow, flushing solids/debris, and stopping flow. In various embodiments one or more of these items can be controlled without human intervention.

In various embodiments the controller can monitor and/or transmit various operational parameters of the debris catching system to a remote location.

In various embodiments the method and apparatus utilizes a pressurized source of fluid to be treated as providing the motive force for treating said fluid. In one embodiment, without requiring any external pump(s) but using the pressurized fluid to be treated, the method can both: (a) capture solids from the fluid in a plurality of debris catchers and (b) flush accumulated solids from at least one debris catcher in the plurality of debris catchers, while continuing to catch debris from the fluid to be treated in another debris catcher from the plurality of debris catchers.

In various embodiments fluid that has been treated in a first debris catcher of the plurality of debris catchers is partially diverted to a second debris catcher in the plurality of debris catchers to flush or clean the second debris catcher.

In various embodiments is provided an apparatus containing

- a redundant debris catcher manifold (having first and second debris catchers),
- a redundant pressure and flow control/choke manifold (having first and second flow control/choke manifolds), and
- an integrated debris flushing system for the first and second debris catchers,
- each of the above items being integrated into a single package/skid.

In one embodiment is provided an integrated:

(a) a debris catcher, (b) pressure control manifold (e.g., choke manifold), and (c) flushing system all three being located on a skid. In various embodiments one or more of the above integrated systems have redundant flow paths.

In various embodiments one or more of the above integrated systems have flow controlled by valves. In various embodiments one or more of the valves can be actuated valves controlled by a controller. In various embodiments the controller can be a programmable logic controller ("PLC").

In one embodiment a single package skid with all components can be integrated allows fast and efficient deployment and rig up.

The invention allows the integration of all components of a flowback or drill-out operation into a single package/skid.

By integrating the debris catcher, pressure control/choke manifold and debris flush, it reduces the time to rig up, personnel rig up HSE exposure and risk, and personnel safety by means of remote/automated actuation.

In various embodiments flow from the well flows into one of the two debris catchers where solid particles of a determined size are captured while allowing the fluids to continue moving to the pressure control/choke manifold.

In various embodiments, upon indication of a first debris catcher vessel filling with "caught" solids (e.g., a pressure differential increase), the flow of the fluid stream to be treated can be switched from the first debris catcher to a second debris catcher without the need to stop flow from the fluid source of the fluid to be treated (e.g., an oil and gas well).

In various embodiments, the flow diversion can be accomplished by remotely controlling a plurality of actuated valves. In various embodiments the valves can be automated and controlled by the PLC control panel.

In various embodiments the flow from the first debris catcher enters a pressure control/choke manifold section where pressure can be reduced and flow rate can be controlled by a choke valve.

In various embodiments, the pressure control/choke manifold section manifold can contain a redundant flow path that includes a second pressure control/choke valve. In the event of the first choke failing or the need to change the choke size, flow can be diverted to the second choke valve without the need to stop the flow. In various embodiments the flow diversion can be accomplished by remotely controlling actuated valves. In various embodiments the valves are automated and controlled by the PLC control panel.

In various embodiments removal of accumulated debris/solids in a second debris catcher can be obtained by diverting at least a portion of the treated and pressure reduced flow from a first debris catcher into integral flush piping of the second debris catcher. In various embodiments the removal of accumulated debris/solids from the second debris catcher can be obtained by diverting all of the fluid flow leaving the first debris catcher into the flush piping of the second debris catcher. In various embodiments the flow can be completely diverted into the second debris.

In various embodiments the removal of accumulated debris/solids from the second debris catcher can occur via opening of a "flushing" valve of the second debris catcher allowing fluid to exit the flushing/cleaning exit of the second debris catcher and into an accumulated debris/solids tank or vessel. In various embodiments, upon completion of the flushing/cleaning of the accumulated debris/solids from the second debris catcher, the "flushing" valve can be closed, and the "cleaned fluid exit" valve for the second debris catcher is opened to continue flowing the well to its destination such as for well operations.

In various embodiments actuated valves can be remotely controlled by means of a controller which can be a PLC controller.

In various embodiments, a plurality of the actuated valves for the method and apparatus can have manual back up valves the event of a failure of an actuated valve.

In one embodiment is provided a debris catcher and choke system for receiving a pressurized fluid stream from wellbore operations comprising: (a) a selectably operable first debris catcher having: (i) a first tubular housing having first and second ends and an interior bore spanning between the first and second ends of the first tubular housing, (i) an inlet at the first end of the first tubular housing, (ii) a first outlet located between the first and second ends of the first tubular housing, (iii) a second outlet at the second end of the first tubular housing, (iv) a first strainer located inside the interior bore of the first tubular housing, the first strainer having a first cylindrical shell with first and second ends and a shell interior bore spanning between the first and second ends of the first cylindrical shell, the first strainer shell creating a first annular space between the first strainer shell and the first cylindrical shell; (b) a selectably operable second debris catcher having: (i) a second tubular housing having first and second ends and an interior bore spanning between the first and second ends of the second tubular housing, (i) an inlet at the first end of the second tubular housing, (ii) a first outlet located between the first and second ends of the second tubular housing, (iii) a second outlet at the second end of the second tubular housing, (iv) a second strainer located inside the interior bore of the second tubular housing, the second strainer having a second cylindrical shell with first and second ends and a shell interior bore spanning between the first and second ends of the second cylindrical shell, the second strainer shell creating a second annular space between the second strainer shell and the second cylindrical shell; (c) a first choke valve selectively connectable by a controller to the first and second debris catchers in each of the following operable states regarding the received fluid stream: (i) downstream of the first outlet of the first tubular housing without being upstream of the first inlet of the first tubular housing, and further without being upstream of the first inlet of the second tubular housing, (ii) downstream of the first outlet of second tubular housing without being upstream of the first inlet of the first tubular housing, and further without being upstream of the first inlet of the second tubular housing, (iii) downstream of the first outlet of first tubular housing and upstream of the first inlet of the second tubular housing, without being upstream of the first inlet of the second tubular housing, and (iv) downstream of the first outlet of second tubular housing and upstream of the first inlet of the first tubular housing, without being upstream of the first inlet of the first tubular housing; (d) wherein, the first debris catcher, second debris catcher, first choke valve, and controller are mounted on a skid, and wherein a the pressurized fluid stream is the sole source of flow for each of the operable states.

In various embodiments the controller is additionally operably connected to a plurality of valves such to selectively open or close various of the plurality of valves, wherein the controller's selective opening or closing of each of the plurality of valves is performed independent of the controllers selective opening or closing of the remaining of the plurality of valves.

In various embodiments while in the operable state of (c)(iii)

a stream of fluid leaving the first choke valve is split into first and second partial streams, the first partial stream being sent to the first inlet of the first tubular housing, and the second partial stream being sent for use in the wellbore operations.

In various embodiments while in the operable state (c)(iv) a stream of fluid leaving the first choke valve is split into first and second partial streams, the first partial stream being sent to the first inlet of the second tubular housing, and the second partial stream being sent for use in wellbore operations.

In various embodiments while in the operable state (c)(iii) a stream of fluid leaving the first choke valve is split into first and second partial streams, the first partial stream being sent to the first inlet of the second tubular housing causing a flushing or cleaning accumulated debris or solids which exit the second outlet of the second tubular housing, and the second partial stream being sent for use in the wellbore operations.

In various embodiments while in the operable state (c)(iv) a stream of fluid leaving the first choke valve is split into first and second partial streams, the first partial stream being sent to the first inlet of the first tubular housing causing a flushing or cleaning accumulated debris or solids which exit the second outlet of the first tubular housing, and the second partial stream being sent for use in the wellbore operations.

In various embodiments while at a time when the first choke valve is not fluidly connected to either the first or second debris catcher regarding the received fluid stream, the controller selectively connects a second choke valve to the first or second debris catchers, in one of the following operable states regarding the received fluid stream: (i) downstream of the first outlet of the first tubular housing without being upstream of the first inlet of the first tubular housing, and further without being upstream of the first inlet of the second tubular housing, (ii) downstream of the first outlet of second tubular housing without being upstream of the first inlet of the first tubular housing, and further without being upstream of the first inlet of the second tubular housing, (iii) downstream of the first outlet of first tubular housing and upstream of the first inlet of the second tubular housing, without being upstream of the first inlet of the second tubular housing, and (iv) downstream of the first outlet of second tubular housing and upstream of the first inlet of the first tubular housing, without being upstream of the first inlet of the first tubular housing; (d) wherein, the first debris catcher, second debris catcher, choke valve, and controller are mounted on a skid, and wherein a the pressurized fluid stream is the sole source of flow for each of the listed states in "c".

In various embodiments while the first choke valve selectively connectable by a controller to the first and second debris catchers in each of the following operable states regarding the received fluid stream: (i) downstream of the first outlet of the first tubular housing and second end of the first strainer without being upstream of the first inlet of the first tubular housing, and further without being upstream of the first inlet of the second tubular housing, (ii) downstream of the first outlet of second tubular housing and second end of the second strainer without being upstream of the first inlet of the first tubular housing, and further without being upstream of the first inlet of the second tubular housing, (iii) downstream of the first outlet of first tubular housing and second end of the first strainer and upstream of the first inlet of the second tubular housing and first end of the second strainer, without being upstream of the first inlet of the second tubular housing, and (iv) downstream of the first outlet of second tubular housing and second end of the second strainer upstream of the first inlet of the first tubular housing and first end of the first strainer, without being upstream of the first inlet of the first tubular housing.

In various embodiments one or more of the plurality of valves can be control valves.

In various embodiments are provided a method of cleaning an oilfield fluid stream comprising the steps of: (a) providing an automated debris catching system, the debris catching system having: (1) a selectably operable first debris catcher having: (i) a first tubular housing having first and second ends and an interior bore spanning between the first and second ends of the first tubular housing, (i) an inlet at the first end of the first tubular housing, (ii) a first outlet located between the first and second ends of the first tubular housing, (iii) a second outlet at the second end of the first tubular housing, (iv) a first strainer located inside the interior bore of the first tubular housing, the first strainer having a first cylindrical shell with first and second ends and a shell interior bore spanning between the first and second ends of the first cylindrical shell, the first strainer shell creating a first annular space between the first strainer shell and the first cylindrical shell; (2) a selectably operable second debris catcher having: (i) a second tubular housing having first and second ends and an interior bore spanning between the first and second ends of the second tubular housing, (i) an inlet at the first end of the second tubular housing, (ii) a first outlet located between the first and second ends of the second tubular housing, (iii) a second outlet at the second end of the second tubular housing, (iv) a second strainer located inside the interior bore of the second tubular housing, the second strainer having a second cylindrical shell with first and second ends and a shell interior bore spanning between the first and second ends of the second cylindrical shell, the second strainer shell creating a second annular space between the second strainer shell and the second cylindrical shell; (3) a first choke valve selectively connectable by a controller to the first and second debris catchers in each of the following operable states regarding the received fluid stream: (i) downstream of the first outlet of the first tubular housing without being upstream of the first inlet of the first tubular housing, and further without being upstream of the first inlet of the second tubular housing, (ii) downstream of the first outlet of second tubular housing without being upstream of the first inlet of the first tubular housing, and further without being upstream of the first inlet of the second tubular housing, (iii) downstream of the first outlet of first tubular housing and upstream of the first inlet of the second tubular housing, without being upstream of the first inlet of the second tubular housing, and (iv) downstream of the first outlet of second tubular housing and upstream of the first inlet of the first tubular housing, without being upstream of the first inlet of the first tubular housing; (4) wherein, the first debris catcher, second debris catcher, first choke valve, and controller are mounted on a skid, and wherein a the pressurized fluid stream is the sole source of flow for each of the operable states; (b) the first debris catcher being in a stream cleaning mode, wherein it receives the oilfield stream in the inlet of the first tubular housing and the stream leaving the first outlet of the first tubular housing has solids removed, and wherein the choke valve is operably connected to the controller regulating a backpressure to the first outlet of the first tubular housing; (c) after step "b" the oilfield stream leaving the automated debris catching system for use in wellbore operations; (d) during step "b" the controller monitoring a first physical parameter regarding the oilfield stream and, if the first physical parameter satisfies a predetermined value, the controller placing: (i) the second debris catcher in a stream cleaning mode, wherein, the second debris catcher receives the oilfield stream in the inlet of the second tubular housing and the oilfield stream leaving the first outlet of the second tubular housing has solids removed, and wherein the choke valve is operably connected to the controller regulating a backpressure to the first outlet of the second tubular housing; and further (ii) the first debris catcher in a flushing mode, wherein at least part of the stream leaving the first outlet of the second tubular housing is directed into the first inlet of the first tubular housing and then exiting the second outlet of the first tubular housing along with accumulated solids from the first debris catcher thereby flushing the first debris catcher.

In various embodiments during step "d", the controller monitoring a second physical parameter regarding the oilfield stream in the first debris catcher and, if the second physical parameter satisfies a predetermined value, the controller placing the first debris catcher in a cleaning mode.

In various embodiments during step "d", the controller monitoring a third physical parameter regarding the oilfield stream in the second debris catcher and, if the third physical parameter satisfies a predetermined value, the controller placing the second debris catcher in a flushing mode.

In various embodiments while the controller monitoring a fourth physical parameter regarding the oilfield stream in the first choke valve and, if the fourth physical parameter satisfies a predetermined value, the controller switching stream flow from the first choke valve to the second choke valve and the second choke valve regulates back pressure.

In various embodiments during step "d" the first physical parameter is selected from the group consisting of pressure, resistance to flow, flow rate, volume of flow, time period of flow, and combinations of any of the foregoing.

In various embodiments during step "d" the second physical parameter is selected from the group consisting of pressure, resistance to flow, flow rate, volume of flow, time period of flow, and combinations of any of the foregoing.

In various embodiments during step "d" the third physical parameter is selected from the group consisting of pressure, resistance to flow, flow rate, volume of flow, time period of flow, and combinations of any of the foregoing.

In various embodiments during step "d" the fourth physical parameter is selected from the group consisting of pressure, resistance to flow, flow rate, volume of flow, time period of flow, and combinations of any of the foregoing.

In various embodiments one or more valves can be opened and/or closed manually. In various embodiments one or more valves can be opened and/or closed automatically based on operating conditions. In various embodiments one of more controlled valves can be isolated by other valves for maintenance and/or replacement.

The drawings constitute a part of this specification and include exemplary embodiments to the invention, which may be embodied in various forms.

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
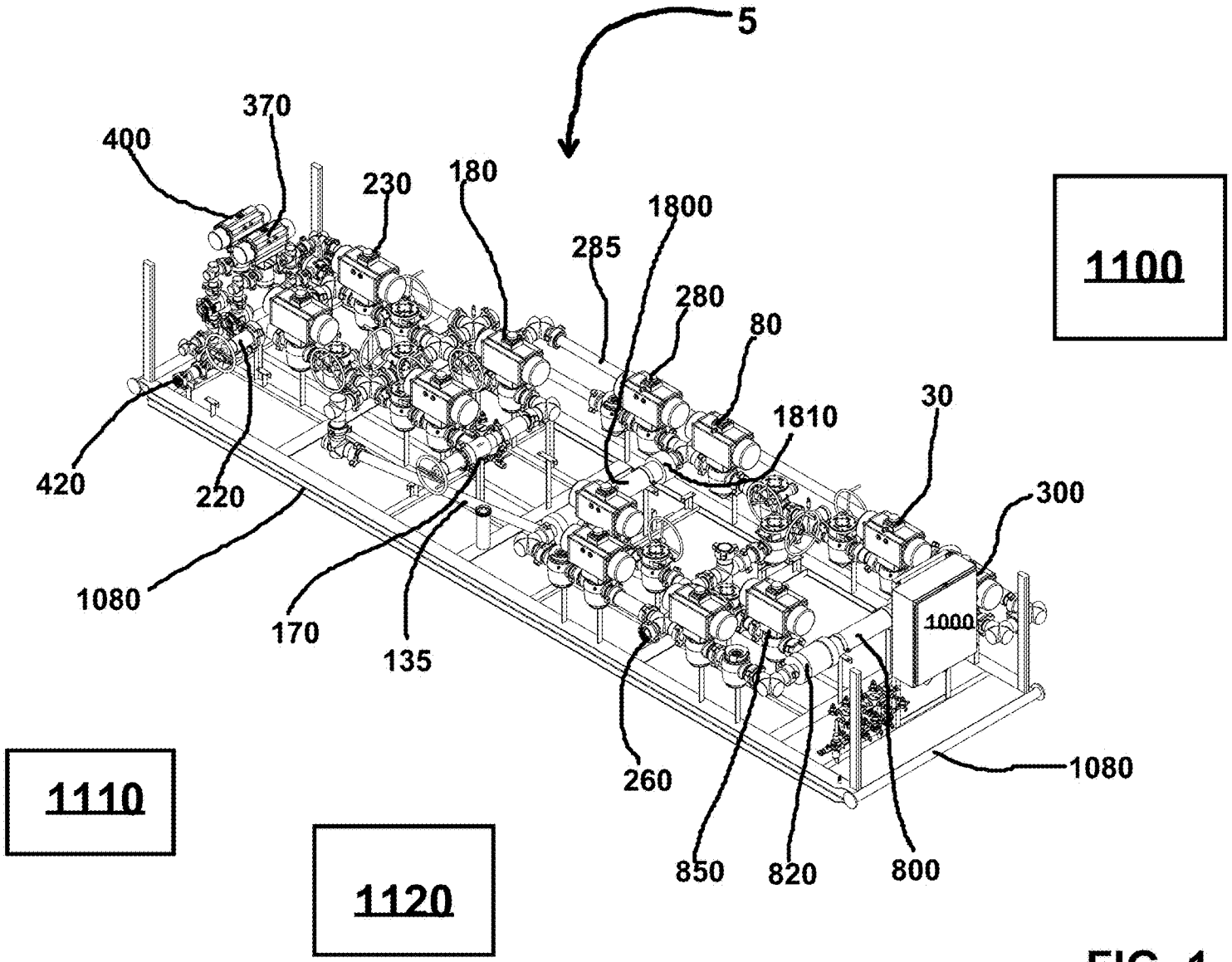
FIG. 1 is an overall perspective view of one embodiment of a skid mounted system which can be used in the method and apparatus.

FIG. 1 is an overall perspective view of one embodiment of a skid mounted system which can be used in the method and apparatus 5.

Generally, the system can include first debris catcher 800, second debris catcher 1800, pressure regulating valve 170, and controller that is operatively connected to a plurality of valves and sensors to selectively place the debris catchers in a debris catching state or flushing or cleaning state, and an externally supplied fluid stream into the inlet of the debris catcher placed in the debris catching mode (either the inlet 810 of first debris catcher 800 or the inlet 1810 of second debris catcher 1800), and such fluid stream will leave the cleaned fluid outlet of the debris catcher in debris catching mode (either second outlet 850 of first debris catcher 800 or second outlet 1850 of second debris catcher 1800), leaving the outlet, passing through a choke valve 170, and then either sent to be used in wellbore operations, or at least part of the stream being directed to the inlet of the debris catcher placed in fluish mode (either the inlet 810 of first debris catcher 800 or the inlet 1810 of second debris catcher 1800) and exiting said debris catch in its flushing exit (either first outlet 820 of first debris catcher 800 or first outlet 1820 of second debris catcher 1800).

Figure 2:
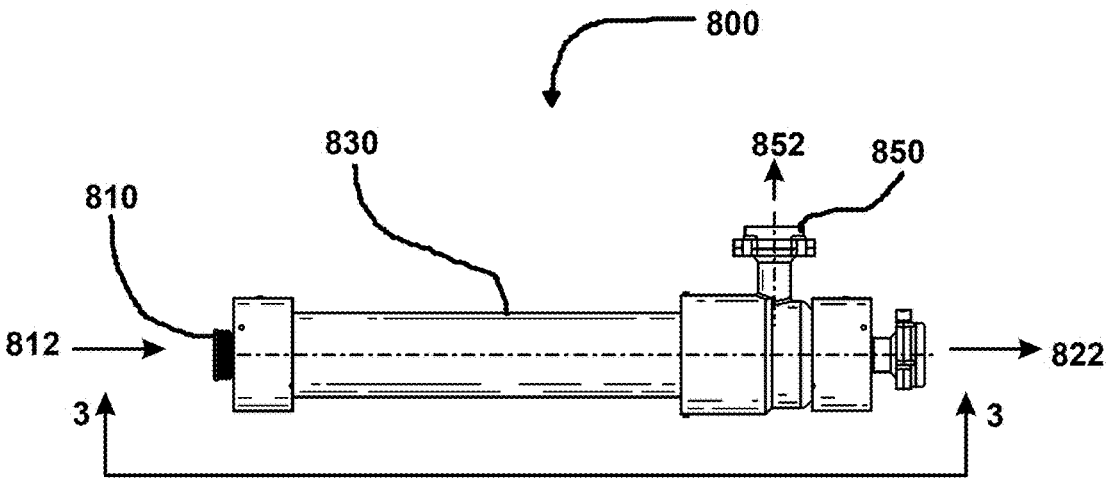
FIG. 2 is a side view of a debris catcher which can be used in the skid mounted system of FIG. 1.
Figure 3:
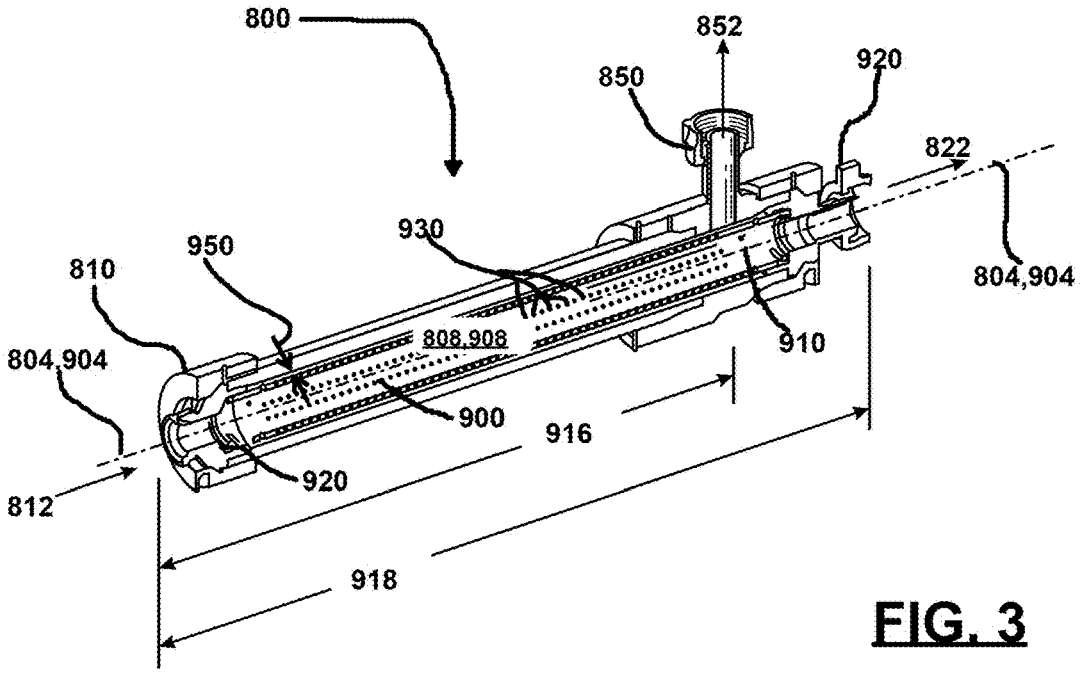
FIG. 3 is a sectional view of the debris catcher of FIG. 2 taken along the lines 3—3.
Figure 4:
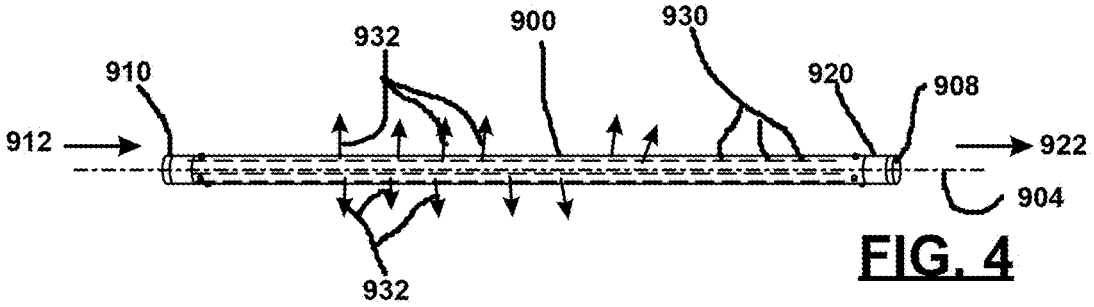
FIG. 4 is a perforated cylindrical shell which can be used in the debris catcher of FIG. 2.

FIG. 2 is a side view of a debris catcher 800 which can be used in the skid mounted system 5 of FIG. 1. FIG. 3 is a sectional view of the debris catcher 800 taken along the lines 3—3. FIG. 4 is a perforated cylindrical shell 900 which can be used in the debris catcher 800.

Generally, debris catcher 800 can include shell 800 which includes inlet 810, clean fluid outlet 850, and flushing outlet 820. Shell 830 can include bore or interior 808 having a longitudinal axis 804. Coaxially located in shell 830 can be a perforated tube 900 which includes first end 910, second end 920, shell 930, bore or interior between the first and second ends, and a plurality of openings or perforations 930 in shell 930. As indicated by FIG. 3, perforated tube 900 can be located in the interior 808 of shell 830 such that the two longitudinal axes 804,904 are coincident. The outer diameter of shell 930 is smaller than the diameter of bore 808 such that an annular space 950 is created between shell 930 and shell 830.

Depending on the flow path of fluid through debris catcher 800, it can be in a cleaning mode or a flushing mode.

Flow in a cleaning mode enters inlet 810 (schematically indicated by arrow 812) and flows into interior 908 of perforated tube. Flushing outlet 820 is blocked and cleaning outlet 850 is opened causing flow to pass through the plurality of perforations 930 of shell 930, into the annular space 950, and exit cleaning outlet 850. Any debris or mud which is larger than the size of the plurality of perforations 930 will be blocked by shell 930 and accumulate in interior 908 of tube 900. Only treated/cleaned fluid will pass through the plurality of perforations 930.

Flow in a flushing mode enters inlet 810 (schematically indicated by arrow 812) and flows into interior 908 of perforated tube. Cleaning outlet 850 is blocked and flushing outlet 820 is opened causing flow to push in the direction of arrows 812 and 822 debris or mud which had accumulated in the interior 908 of perforated tube and causing it to exit flushing outlet 820.

Catching Debris From a Fluid Source Using Selectable LH or RH Debris Catchers Fluid source A passing through LH debris catcher, and then sent to an oil field service application.

Fluid source A passing through RH debris catcher, and then sent to an oil field service application.

The selection of either LH or RH debris catcher is made by changing the states of one or more valves fluidly connected to LH and/or RH debris catchers.

Changing Debris Catcher Between Modes of Debris Catching and Flushing or Cleaning Switching From Debris Catching to Flushing or Cleaning As a debris catcher catches or removes debris from a fluid source, the resistance to further fluid flow through the debris catcher will increase causing the inlet pressure of the debris catcher to increase. In one embodiment, a pressure for the debris catcher is measured and, if that pressure exceeds a predetermined target debris catching pressure, then the debris catcher is placed in a flushing or cleaning mode to remove debris from the debris catcher. In one embodiment the predetermined target debris catching pressure must be exceeded for a predetermined target time period of continued high debris catching pressure before the debris catcher is placed in the flushing or cleaning mode. In one embodiment, the debris catcher is placed in the flushing or cleaning mode after the time period of flow thru the debris catcher exceeds a predetermined target maximum debris catching time period for fluid flow through the debris catcher.

Switching From Flushing or Cleaning to Debris Catching

In the flushing or cleaning mode, fluid can be flowed through debris catcher and during the time of flow of such flushing or cleaning fluid, the resistance to fluid flow through the debris catcher will decrease causing the inlet pressure of the debris catcher to decrease. In one embodiment, a pressure for the debris catcher is measured and, if that pressure drops below a predetermined target flushing or cleaning pressure, then the debris catcher is placed in a debris catching mode. In one embodiment the predetermined target flushing or cleaning pressure must be below for a predetermined target time period of continued low debris flushing or cleaning pressure before the debris catcher is placed debris catching mode. In one embodiment, the debris catcher is placed in the debris catching mode after time period of flow thru the debris catcher while in the flushing or cleaning mode exceeds a predetermined target maximum debris flushing or cleaning time period for flushing or cleaning fluid flow through the debris catcher.

Simultaneous Debris Catching With A First Debris Catcher While Flushing Or Cleaning A Second Debris Catcher Fluid from fluid source A passing through LH debris catcher, and (a) a first part of fluid from fluid source A that has passed through LH debris catcher being directed for use in an oil field service application, (b) a second part of fluid that has passed through LH debris catcher being passed through RH debris catcher to clean/flush RH debris catcher, and (c) both (a) and (b) being performed while fluid from fluid source A passes through LH debris catcher.

Fluid from fluid source A passing through RH debris catcher, and (i) a first part of fluid from fluid source A that has passed through RH debris catcher being directed for use in an oil field service application, (ii) a second part of fluid that has passed through LH debris catcher being passed through LH debris catcher to clean/flush LH debris catcher, and (iii) both (i) and (ii) being performed while fluid from fluid source A passes through RH debris catcher.

Same Fluid Stream Source A For Fluid Flow Through both (a) First Debris Catcher in Debris Catching Mode and (b) Second Debris Catcher in Flushing or Cleaning Mode, The Same Pressure Regulating Device Causing a First Pressure For The Debris Catching Mode And A Second Pressure For the Flushing or Cleaning Mode Where the First Pressure Is Different From The Second Pressure Generally, the pressure of the fluid stream entering the first debris catcher in the debris catching mode (e.g. the First Pressure) is expected to be greater than the pressure of the fluid entering the second debris catcher in the flushing or cleaning mode (e.g., the Second Pressure). This is because the fluid entering the second debris catcher in the flushing or cleaning mode has passed through the pressure regulating device (e.g., a pressure controlling or choke valve) causing a pressure drop before the fluid stream enters the debris catcher in the flushing or cleaning mode. Adding the overall difference between the pressures of the fluid entering (a) the first debris catcher in the debris catching mode (First Pressure) and (b) the second debris catcher in the flushing or cleaning mode (Second Pressure) is the pressure drop of the fluid stream as it passes through the first debris catcher in the debris catching mode.

Generally, the pressure regulating device (e.g., a pressure controlling or choke valve) can vary and control both the First Pressure and the Second Pressure. For example, as pressure regulating device is set to increase resistance to flow through itself, it (a) increases a back-pressure which must be overcome for flow through the pressure regulating device thereby increasing the First Pressure (the fluid entering the first debris catcher in the debris catching mode (First Pressure) and (b) increases the pressure drop across pressure regulating device thereby decreasing the Second Pressure (the fluid entering the second debris catcher in the flushing or cleaning mode).

Reserve Pressure Regulating Device And Bypass Flow

In one embodiment, first and second pressure regulating devices are provided each of which can be selectively fluidly connected for regulating First and Second Pressures. In one embodiment second pressure regulating device can be a reserve pressure regulating device. Such a "reserve condition" allows the first pressure regulating device to be used while repairs and/or maintenance are simultaneously performed on the second pressure regulating device and vice versa.

In one embodiment a bypass is provided which allows flow to be bypassed either or both of the first and second pressure regulating devices.

Reserve Valving For Flow Paths

In one embodiment, flow path(s) of the fluids are controlled by a plurality of valves. In one embodiment for one or more valves are reserve or failsafe valves and can be paired with the one or more primary valves. For example, in one embodiment certain valves can be controlled by a controller but one or more of these "control" valves can be paired with manually operated valves. For example, in this embodiment a user can manually control (e.g., stop) flow with the "paired manual" valve if its sister automatically controlled valve is stuck in an open position.

Figure 5:
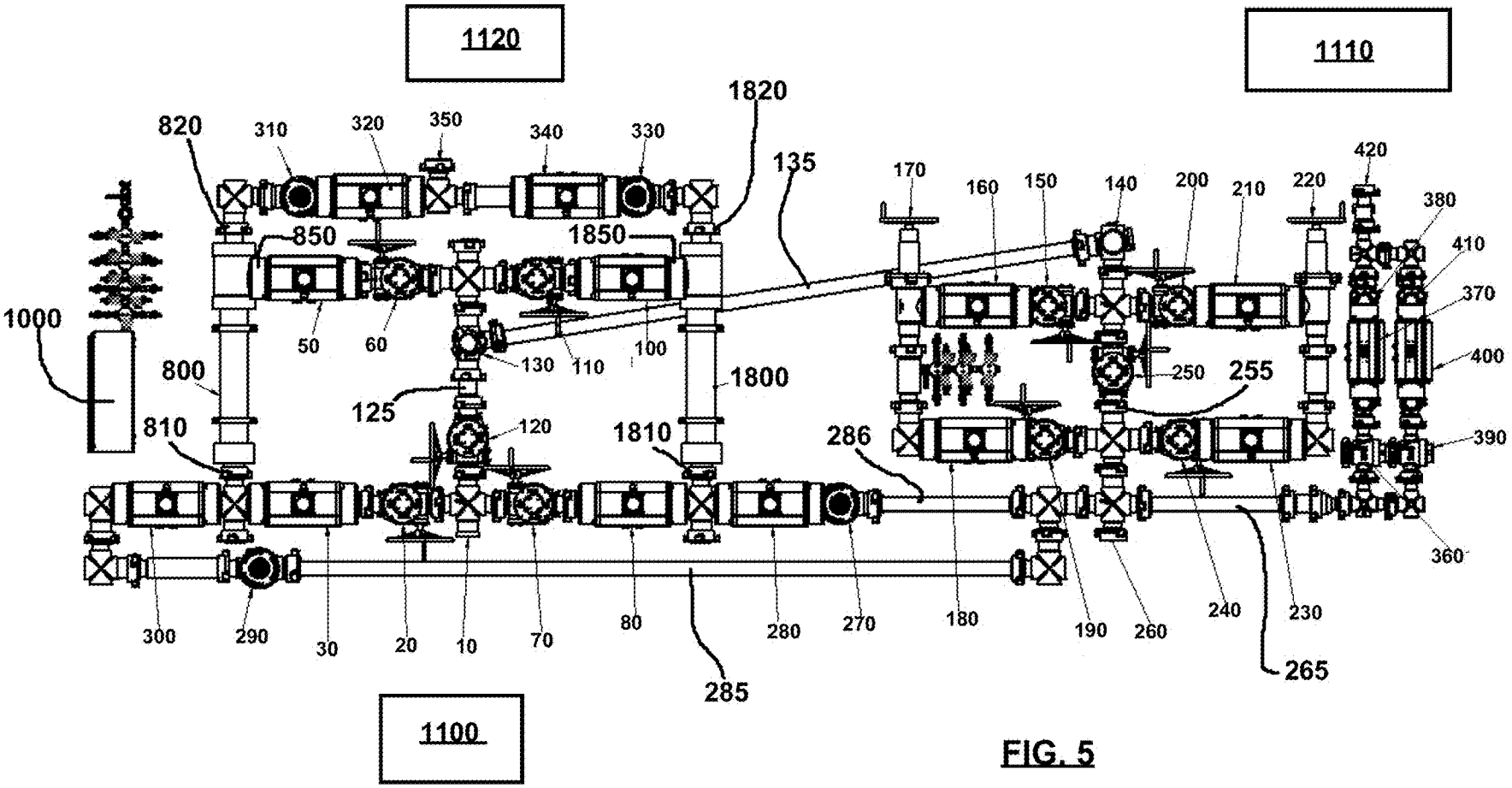
FIG. 5 is a schematic piping layout of the skid mounted system of FIG. 1 with the piping expanded horizontally to show the various possible flow paths.
Figure 10:
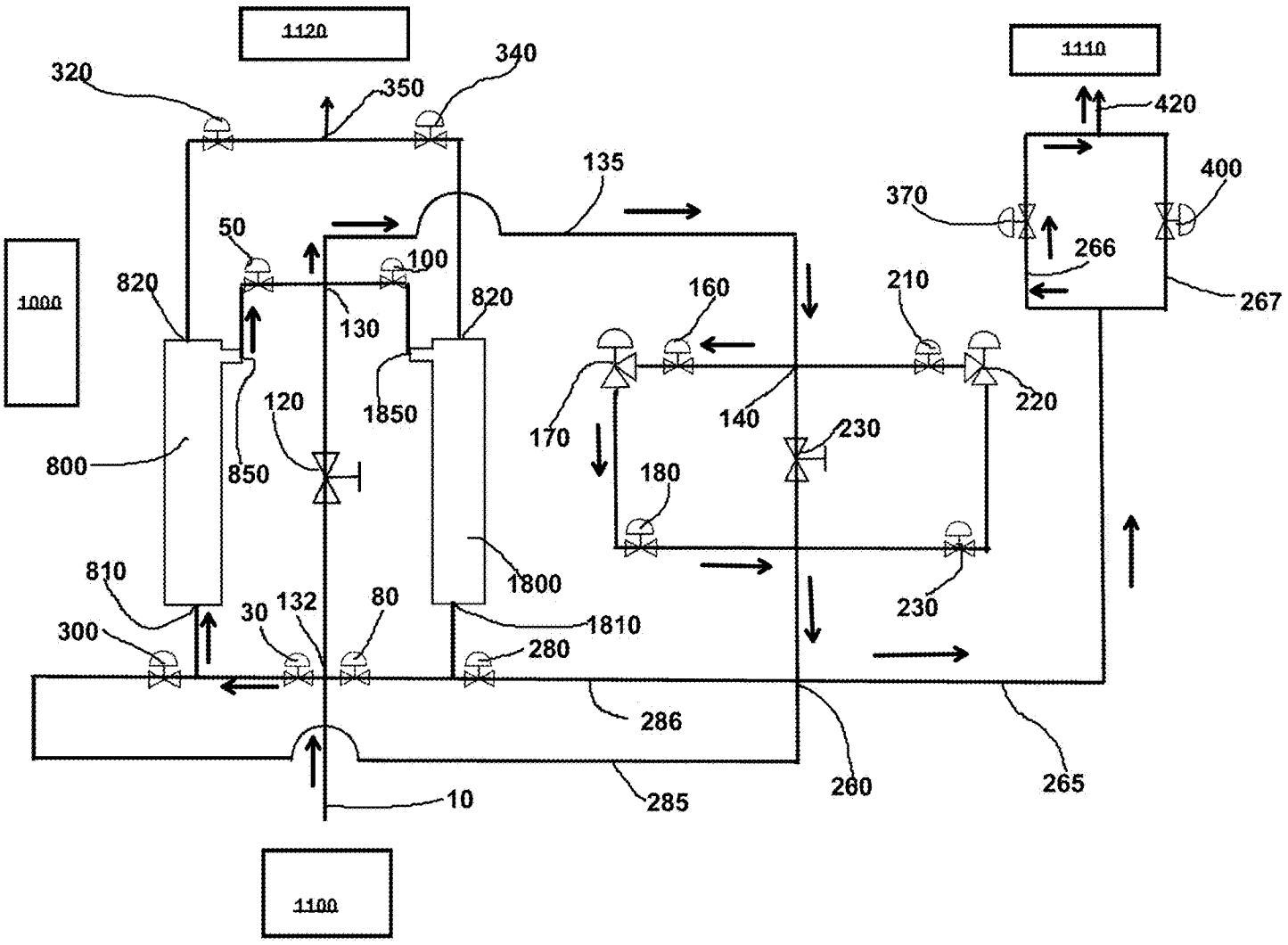
FIG. 10 is a simplified flow diagram of the method and apparatus as shown in FIG. 6 (with redundant valving omitted for simplicity).
Figure 13:
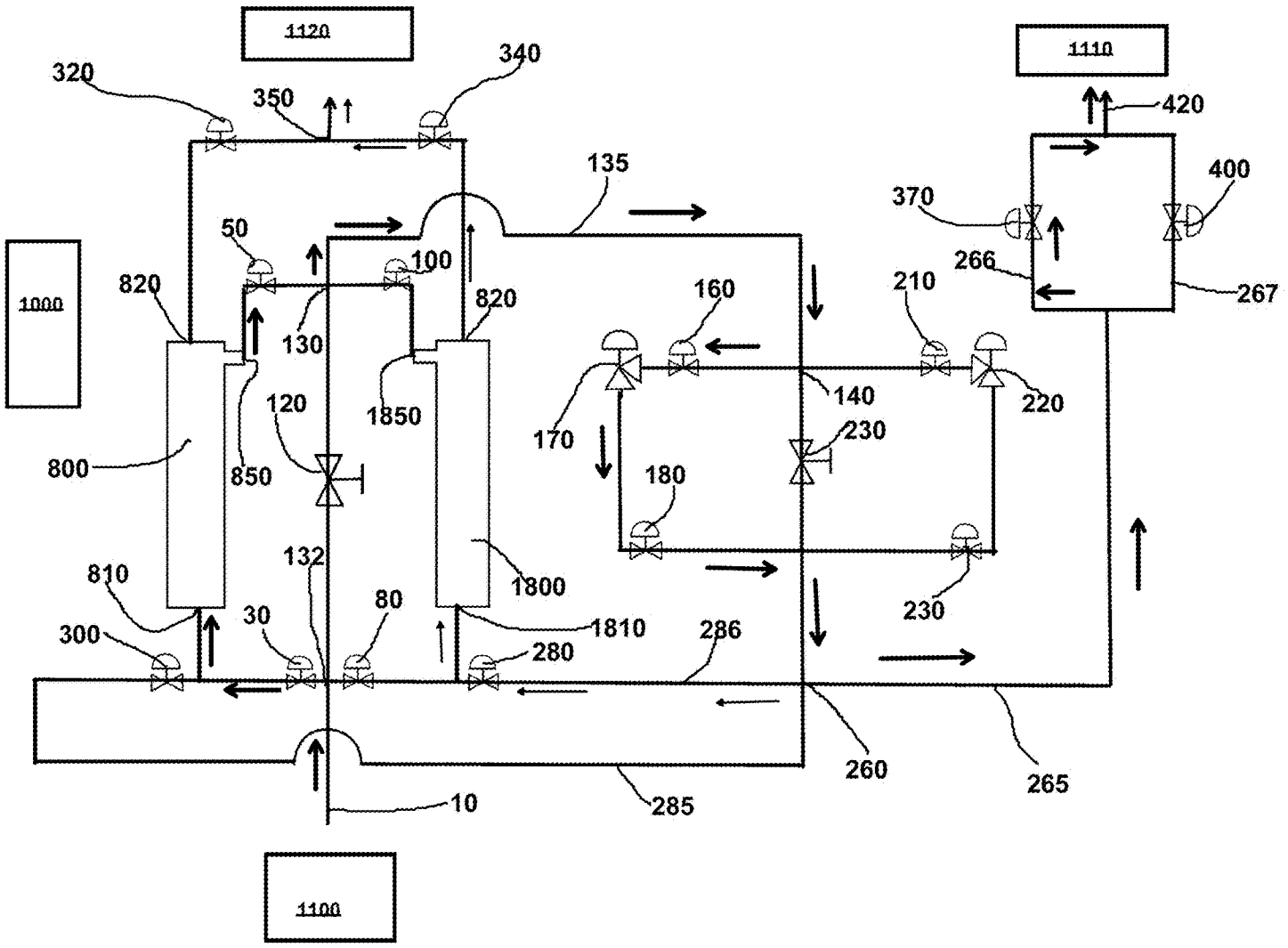
FIG. 13 is a simplified flow diagram of the method and apparatus as shown in FIG. 9 (with redundant valving omitted for simplicity).
Figure 14:
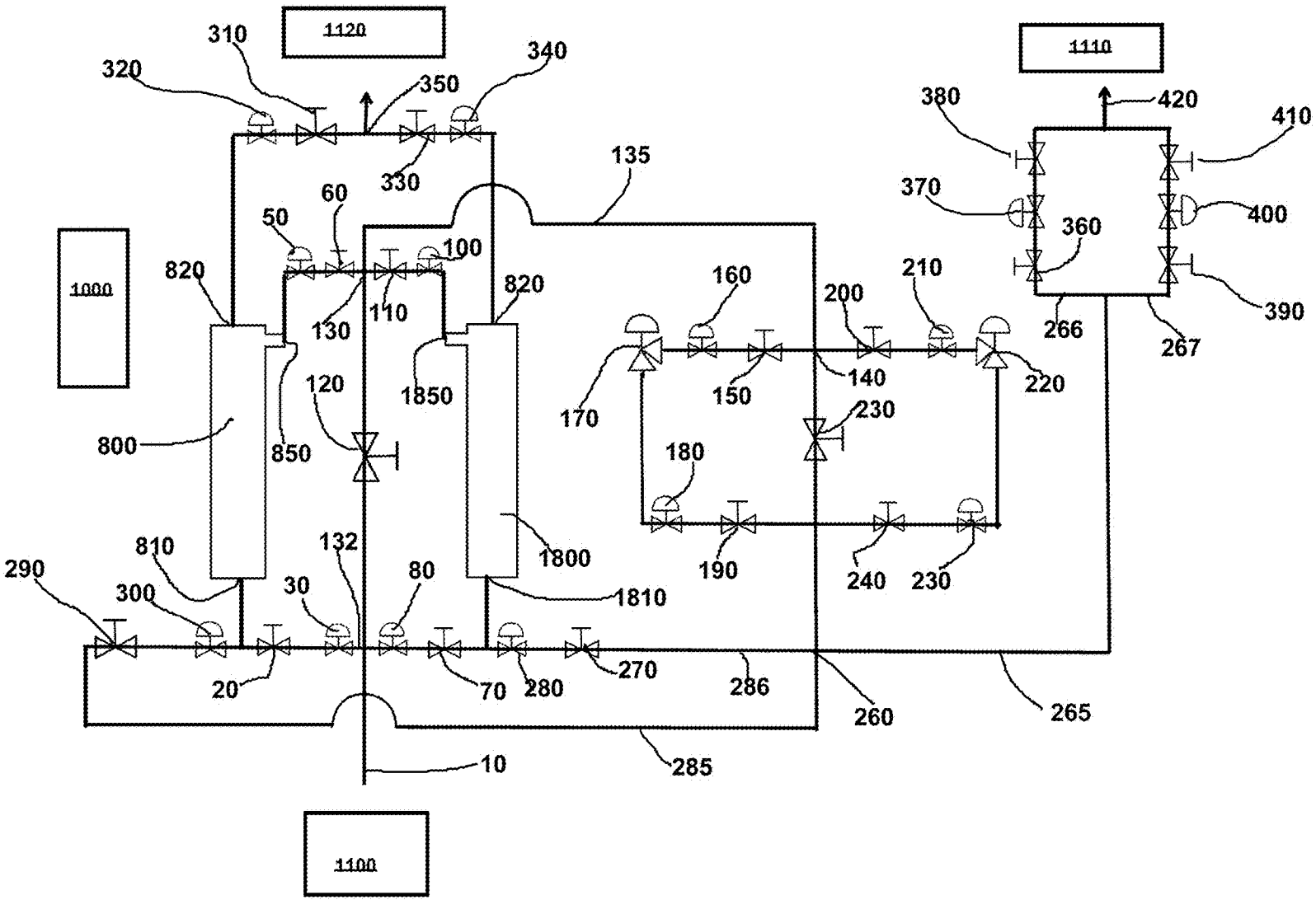
FIG. 14 is a simplified diagram of the method and apparatus but now showing the redundant valving of FIG. 5.

FIG. 14 is a simplified diagram of the method and apparatus but now showing the redundant valving of FIG. 5. Compared to FIG. 10, FIG. 14 shows additional valves 20, 60, 70, 110, 150, 190, 200, 240, 270, 290, 320, 330, 360, 380, 390, and 410. These valves are normally in an open state and are manual valves so do not impact the normal operating flows pathways controlled by controller 1000. Accordingly, they have been omitted for simplicity in the schematic diagrams of FIGS. 10 through 13. However, one or more of these valves can be manually closed for example, in case of a failure of the valve paired with said valve that is controlled by controller 1000.

Valve 120 is a manually operated valve that is normally closed. However, valve 120 can be opened manually to by-pass both debris catchers 800 and 1800 (from 10 directly to line 135). Similarly, valve 230 is a manually operated valve that is normally closed. However, valve 230 can be opened to by-pass both choke valves 170 and 220 (from line 135 directly to line 265).

Catching Debris Contained in Fluid Source A Via First Debris Catcher (Flow Path 2000)

Figure 6:
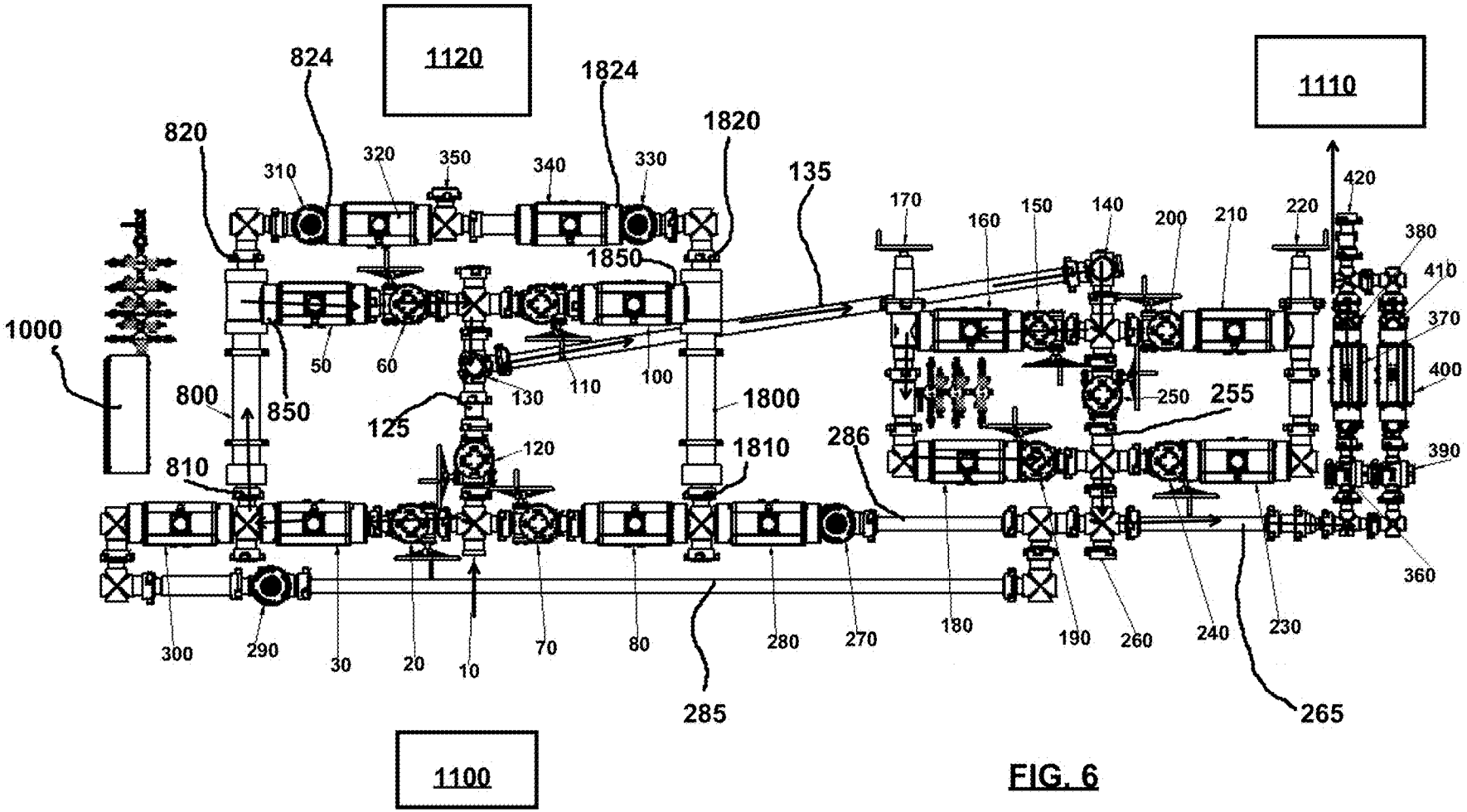
FIG. 6 is the piping layout of FIG. 5 schematically indicating the first or left hand debris catcher catching flow of fluid passing therethrough.

As schematically indicated in FIG. 6, fluid source A (e.g., well effluents) can enter apparatus 5 at inlet 10, pass through valve 20, valve 30, and into first debris catcher 800 via inlet 810. FIG. 10 is a simplified flow diagram of the method and apparatus as shown in FIG. 6 (with redundant valving omitted for simplicity).

Solids within the fluid source are captured inside first debris catcher 800 via a selective screen/filter 900.

The now screened/filtered fluids exit debris catcher 800 via outlet 850 continuing to flow through valve 50, valve 60, entering T-component 130, and then through pipe 135. The flow leaving pipe 135 enters T-component 140, passes through valve 150, valve 160, and enters pressure/flow control valve 170 (which can be a choke valve). Controller 1000 can be operatively connected to valve 170 such that flow rate of the screened/filtered fluid stream along with the pressure drop across valve 170 which can be an adjustable or fixed diameter choke. By controlling amount of opening of valve 170 controller 1000 can control flow rate and pressure drop of the fluid stream through valve 170, along with the backpressure in line 135 seen by outlet 850 of first debris catcher 800.

The now pressure reduced flow continues through valve 180, valve 190, and then to diverting component 260.

The above described flow path from inlet 10 through first debris catcher 800 and to diverting component 260 is collectively called flow path 2000 (e.g., flow path indicated by arrows 502, 504, 506, 508, 510, 512, 514, 516, 518, 520, and 522).

To direct fluid flow through flow path 2000 controller 1000 can maintain in an open condition valves 30, 50, 160, and 180, while maintaining in a closed condition valves 80, 100, 210, 300, and 320.

The fluid stream from the diverting component 260 continues to flow through valve 360, valve 370, valve 380, and exits the system 5 through exit 420 (e.g., flow path indicated by arrows 550, 552, 554, 556, 558, and 560). To direct fluid from diverting component 260 to exit 420, controller 1000 can maintain in an open condition valve 266, while maintaining in a closed condition valves 280, 300, and 400.

After exiting system 5, fluid stream can be used in an oilfield process such as drilling or well fracturing (schematically indicated as operation 1100).

Catching Debris Contained in Fluid Source A Via Second Debris Catcher (Flow Path 2

100)

Figure 8:
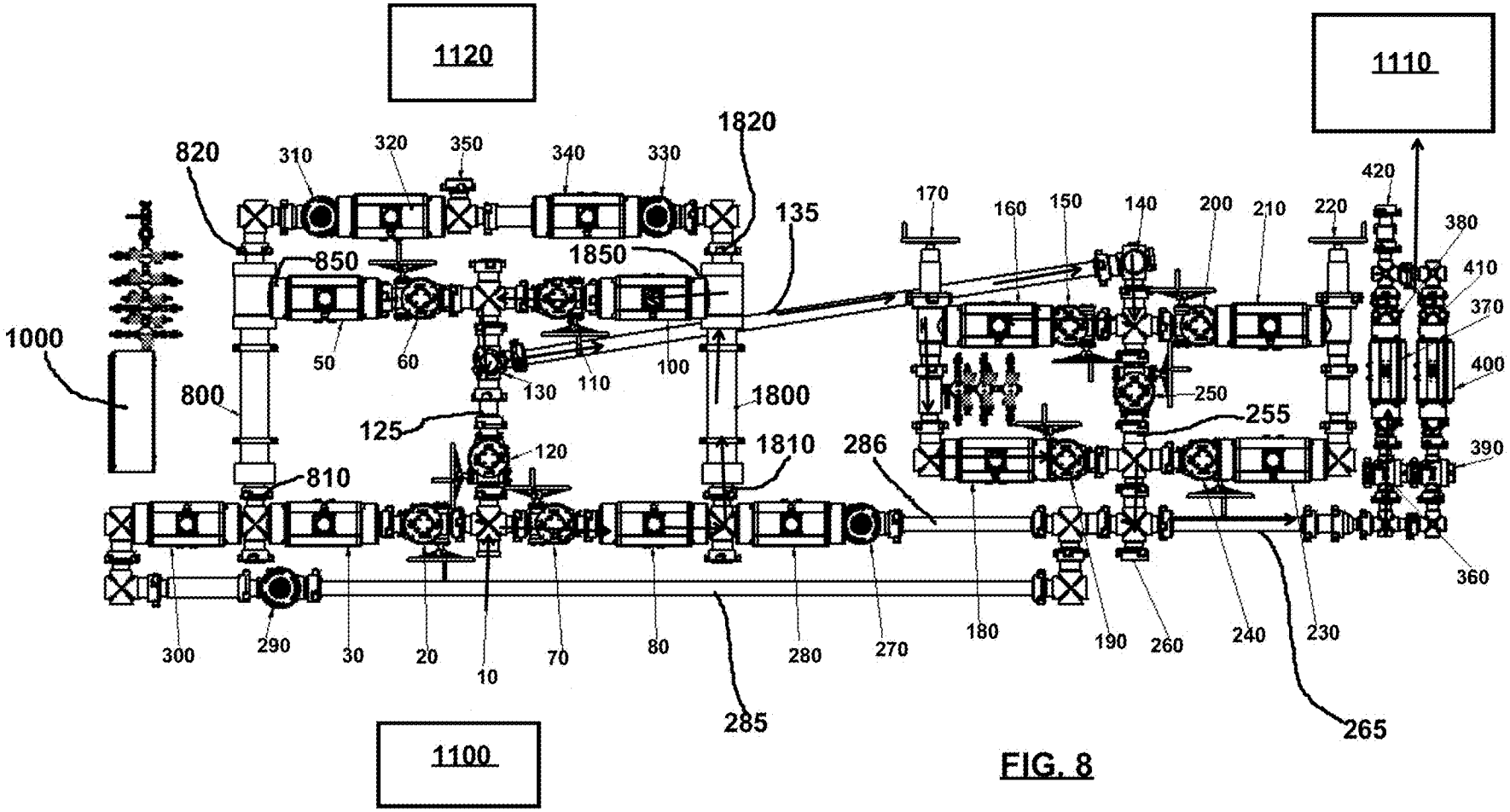
FIG. 8 is the piping layout of FIG. 5 schematically indicating the second or right hand debris catcher catching flow of fluid passing therethrough.
Figure 12:
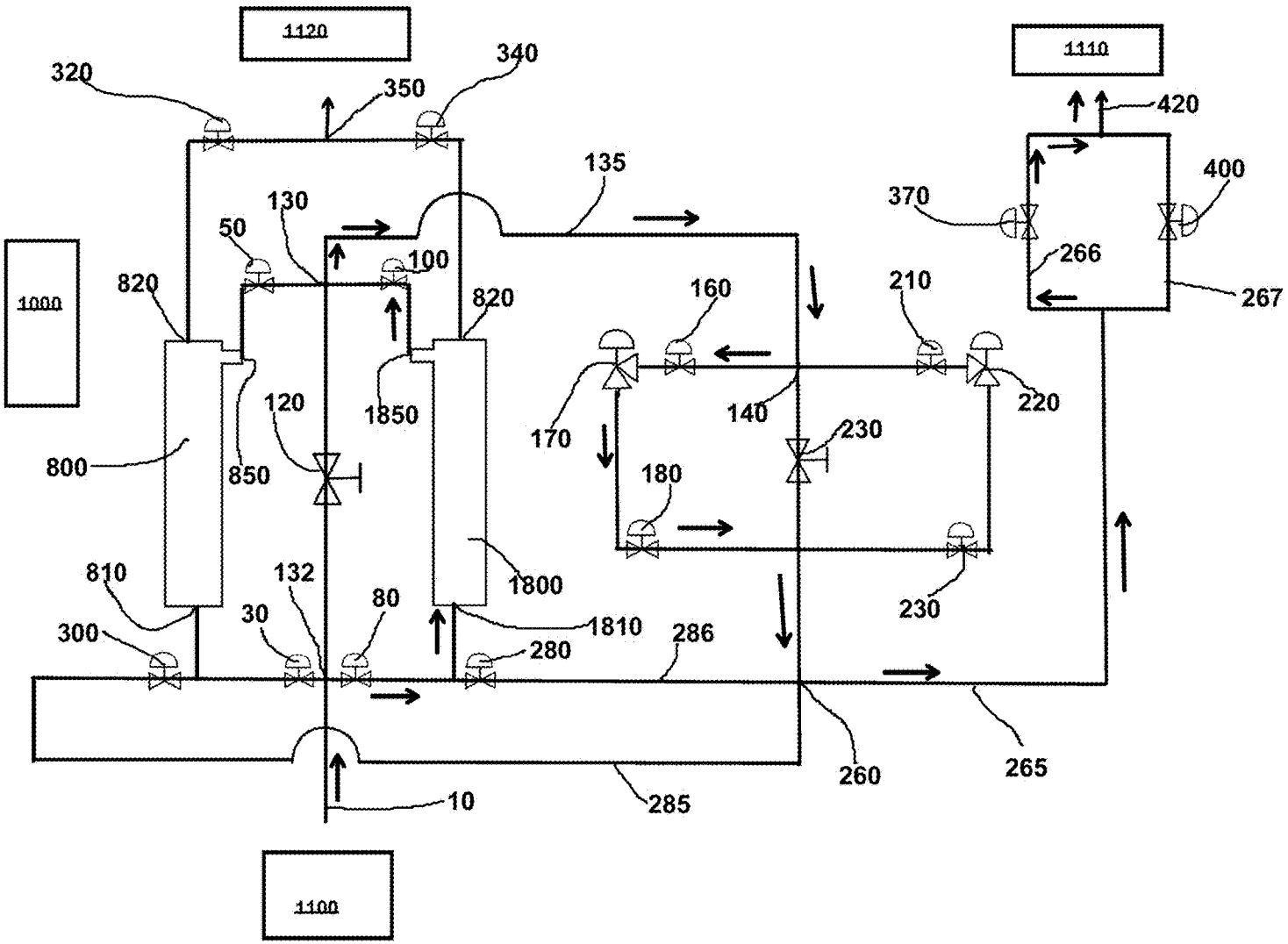
FIG. 12 is a simplified flow diagram of the method and apparatus as shown in FIG. 8 (with redundant valving omitted for simplicity).

FIG. 8 is the piping layout of FIG. 5 schematically indicating the second debris catcher 1800 catching flow of fluid passing therethrough. FIG. 12 is a simplified flow diagram of the method and apparatus as shown in FIG. 8 (with redundant valving omitted for simplicity). As schematically indicated in FIG. 12, alternatively, fluid source A (e.g., well effluents) can enter inlet 10, pass through valve 70, valve 80, and into second debris catcher 1800 via inlet 1810.

Solids within the fluid source A are captured inside second debris catcher 1800 via a selective screen/filter 900'.

The now screened/filtered fluids exit second debris catcher 1800 via outlet 1850 continuing to flow through valve 100 and valve 110, entering T-component 130, and then through pipe 135. The flow leaving pipe 135 enters T-component 140, passes through valve 150, valve 160, and enters pressure/flow control valve 170 (which can be a choke valve).

Controller 1000 can be operatively connected to valve 170 such that flow rate of the screened/filtered fluid stream along with the pressure drop across valve 170 which can be an adjustable or fixed diameter choke. By controlling amount of opening of valve 170 controller 1000 can control flow rate and pressure drop of the fluid stream through valve 170, along with the backpressure in line 135 seen by outlet 1850 of second debris catcher 1800.

The now pressure reduced flow continues through valve 180, valve 190, and then to diverting component 260. The above described flow path from inlet 10 through second debris catcher 1800 and to diverting component 260 is collectively called flow path 2100 (e.g., flow path indicated by arrows 602, 604, 606, 608, 610, 612, 614, 616, 618, 620, and 622).

To direct fluid flow through flow path 2100 controller 1000 can maintain in an open condition valves 80, 100, 160, and 180, while maintaining in a closed condition valves 30, 50, 210, and 280.

The fluid stream from the diverting component 260 continues to flow through valve 360, valve 370, valve 380, and exits the system 5 through exit 420 (e.g., flow path indicated by arrows 650, 652, 654, 656, 658, and 660).

To direct fluid from diverting component 260 to exit 420, controller 1000 can maintain in an open condition valve 266, while maintaining in a closed condition valves 280, 300, and 400.

After exiting system 5, fluid stream can be used in an oilfield process such as drilling or well fracturing (schematically indicated as operation 1100).

Fluid stream from the diverting component 260 flows through valve 360, valve 370, valve 380, and exits the system 5 through exit 420. After exiting system 5, fluid stream can be used in an oilfield process such as drilling or well fracturing (schematically indicated as operation 1110).

Switching to Catching Debris Contained In Fluid Source A Via Second Debris Catcher, While Simultaneously Using Fluid Source A to Clean/Flush First Debris Catcher Eventually first debris catcher 800 will become substantially filled with debris from fluid A flowing through it. First debris catcher 800 can be cleaned or flushed of such debris.

Figure 7:
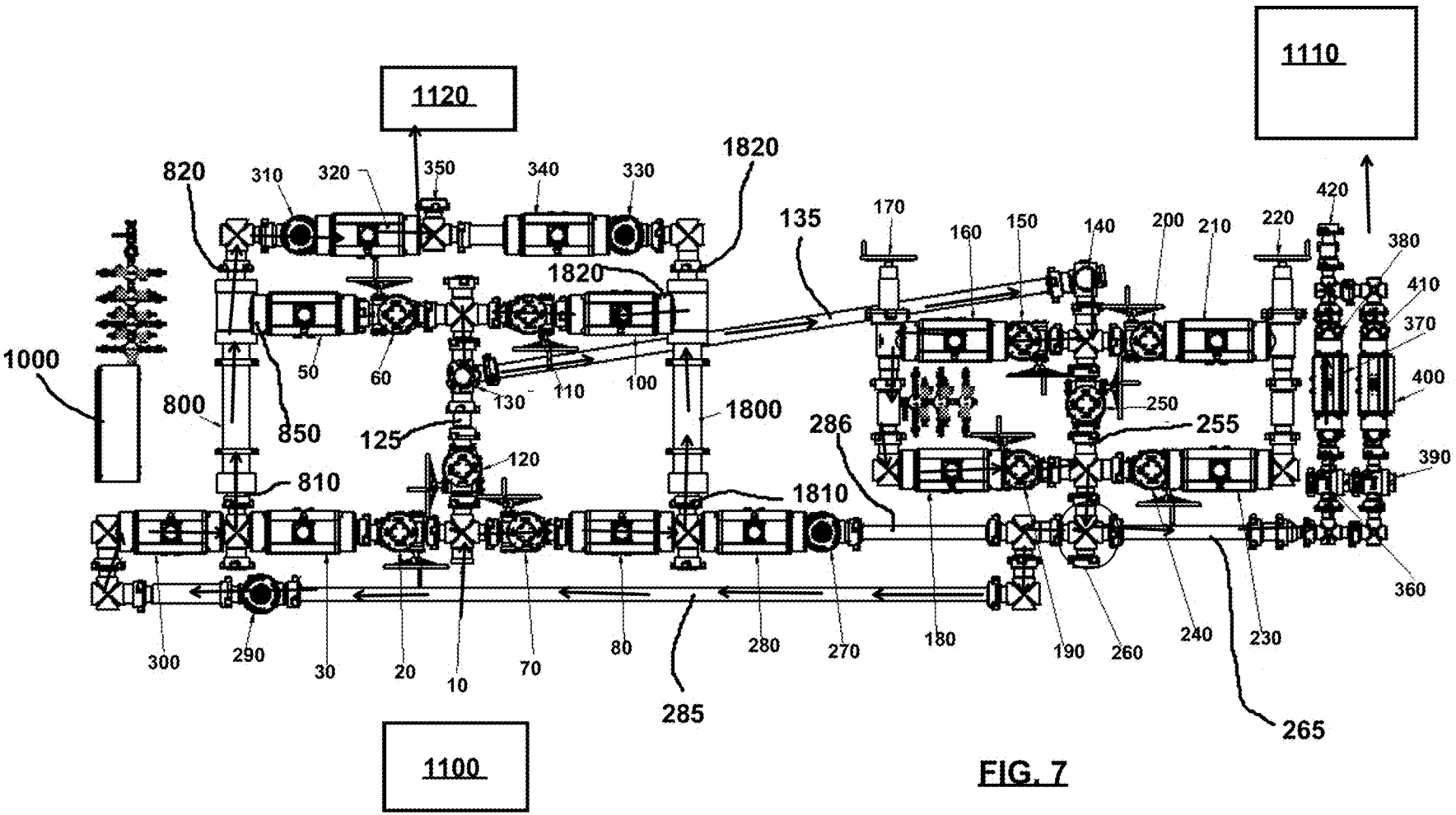
FIG. 7 is the piping layout of FIG. 5 schematically indicating the first or left hand debris catcher being fluished/cleaned while the second or right hand debris catcher is catching flow of fluid passing therethrough.
Figure 11:
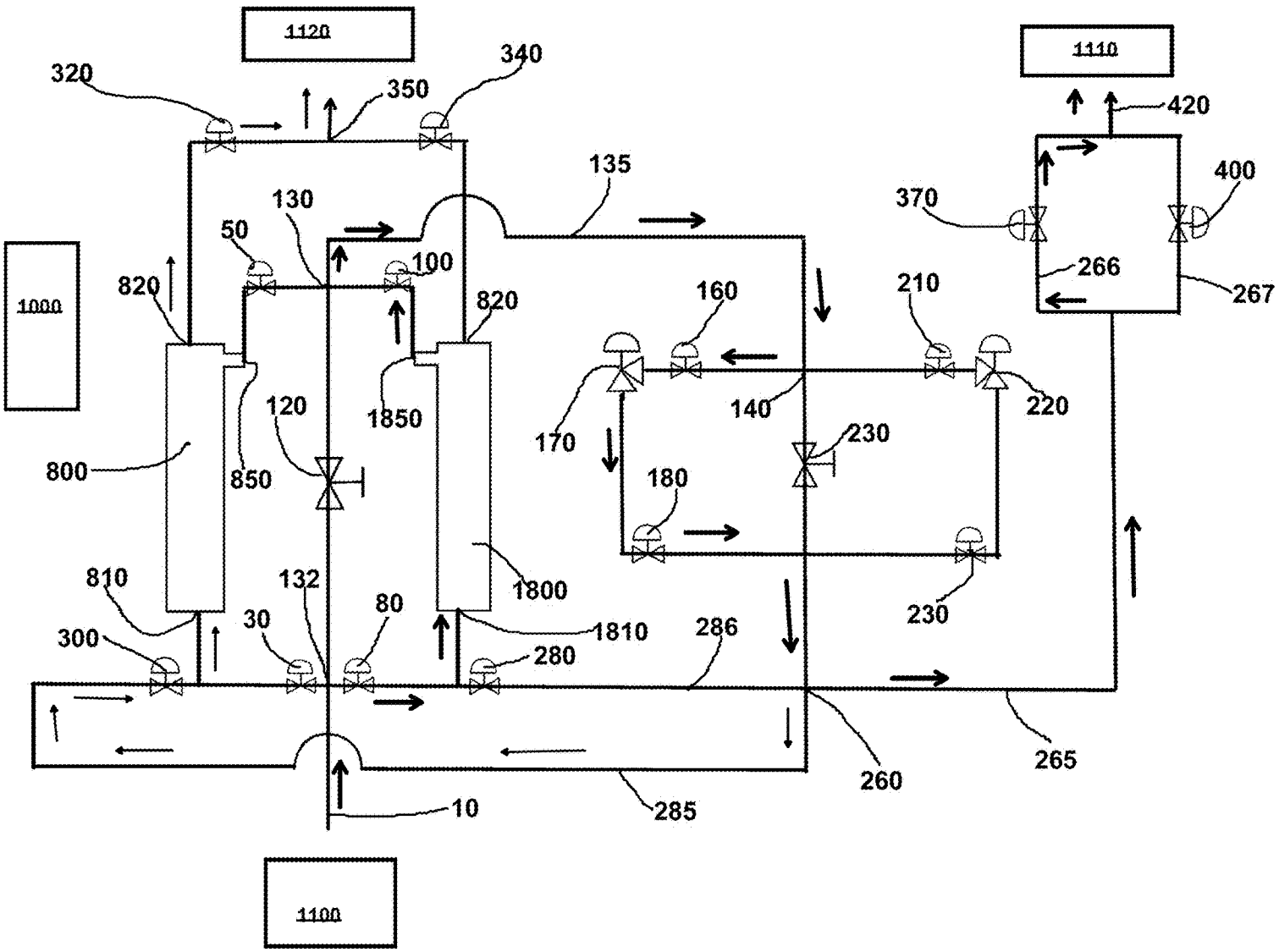
FIG. 11 is a simplified flow diagram of the method and apparatus as shown in FIG. 7 (with redundant valving omitted for simplicity).

In one embodiment first debris catcher 800 can be cleaned or flushed of debris without disrupting the flow of fluid stream A into apparatus 5. FIG. 7 is the piping layout of FIG. 5 schematically indicating the first debris catcher 800 (left hand debris catcher) being fluished/cleaned while the right hand debris catcher is catching flow of fluid passing therethrough. FIG. 11 is a simplified flow diagram of the method and apparatus as shown in FIG. 7 (with redundant valving omitted for simplicity).

In one embodiment first debris catcher 800 can be cleaned or flushed of debris while second debris catcher 1800 simultaneously catches debris from fluid stream A.

In one embodiment the fluid stream exiting second catcher 1800 can be used to flush or clean first catcher 800 while second debris catcher 1800 simultaneously catches debris from fluid stream A.

Upon detection of first debris catcher 800 becoming filled (for example by measuring an increase of differential pressure over a target amount, or other decision), the flow of fluid stream A to apparatus 5 (via inlet 10) does not need to be stopped to flush/clean the debris located inside first debris catcher 800.

In one embodiment, to flush/clean a now full first debris catcher 800, flow of fluid stream A from inlet 10 is diverted from first debris catcher 800 to second debris catcher 1800 so that second debris catcher 1800 now catches debris from fluid stream A. This can be done by controller 1000 opening and closing various valves so that flow from fluid stream A starting at inlet 10 now follows flow path 2100 (e.g., flow path indicated by arrows 602, 604, 606, 608, 610, 612, 614, 616, 618, 620, and 622). To direct fluid flow through flow path 2100 controller 1000 can maintain in an open condition valves 80, 100, 160, and 180, while maintaining in a closed condition valves 30, 50, 210, and 280.

However, part of the fluid stream A exiting second debris catcher 1800 can be used to flush or clean first debris catcher 800. In this embodiment the apparatus 5 can be switched from flow path 2000 (schematically shown in FIG. 6) to flow path 2100 (schematically shown in FIG. 7). To direct fluid flow through flow path 2100 controller 1000 can maintain in an open condition valves 80, 100, 160, and 180, while maintaining in a closed condition valves 30, 50, 210, and 280.

To partially direct flow to flush first debris catcher 800, controller 1000 can open valves 300 and 320 (and close valve 50) so that at least part of the flow leaving second debris catcher 1800 from its second outlet 850 through pipe 135, through valve 160 and to junction 260, will be diverted from junction 260 to enter pipe 285 pass through valve 300, enter first inlet 810 of first debris catcher 800, and exit second outlet 820 of first debris catcher 800 (e.g., flow path indicated by arrows 670, 672, 672, 676, 678, 680, and 682), passing through valve 320 and exiting outlet 350 to storage tank 1120 (e.g., flow path indicated by arrows 682, 684, and 686).

Such flushing or cleaning of first debris catcher 800 can be performed while cleaned fluid from fluid stream A is still output at clean fluid output 420 so that this output can provide a continuous stream of cleaned fluid from fluid stream A. At diverting component 260, part of the fluid stream A leaving second debris catcher 1800 can be diverted to clean or flush first debris catcher 800 (e.g., flow path indicated by arrows 670, 672, 672, 676, 678, 680, and 682), while the remaining portion of the fluid stream leaving debris catcher 1800 leaves flows through diverter 260, valve 370, and valve 380 and exits the system through component 420 and can be used in an oilfield process such as drilling or well fracturing (e.g., flow path schematically indicated by arrows 650, 652, 654, 656, 658, and 660).

The part of the fluid stream leaving second debris catcher 1800 that is diverted to first debris catcher 800, enters pipe 285 through valve 290, valve 300, and into first debris catcher 800 (e.g., flow path schematically indicated by arrows 670, 672, 674, 676, 678, and 680), flowing through first debris catcher 800 (and exiting at outlet 850), to valve 310, valve 320, and finally exiting system 5 via outlet or exit component 350 (e.g., flow path schematically indicated by arrows 682, 684, and 686). Here, the fluid passing through first debris catcher 800 is fluid from fluid stream A but after such fluid has previously passed through second debris catcher 1800 (exiting this second debris catcher 1800 at outlet 1850). In this manner debris/dirt can be cleaned/caught from fluid stream A while simultaneously the fluid from fluid stream A (after leaving second debris catcher 1800) can clean/flush out first debris catcher 800.

While flowing through flow path 2100, valve 80 and valve 100 are opened to allow fluid flow and debris to be captured by second debris catcher 1800. Upon verification of the valves open, valve 30 and vale 50 are closed.

Flow continues through flow path 2100 (using second debris catcher 1800) of the debris catcher section.

In order to flush the debris captured inside first debris catcher 800, valve 300 is opened allowing flow from diverting component 260 of the pressure/flow control section through pipe 285 and into inlet 810 of first debris catcher 800 to flush out any debris inside this unit leaving debris outlet 820 (e.g., flow path schematically indicated by arrows 670, 672, 674, 676, 678, and 680). Valve 320 is opened to release the pressure trapped in first debris catcher 800 pushing the captured debris through outlet 820 and exiting exit component 350, thereby exiting the system 5 to a debris/dirt processing or waste unit 1120. If additional flow is required to first debris catcher 800 to flush out its accumulated debris, valve 370 of the pressure/flow control section can be closed to divert the entire flow leaving choke valve 170 (from flow path 2100) to the inlet 810 of first debris catcher 800.

Even after first debris catcher 800 is cleaned or flushed as described above, second debris catcher 1800 can continued to be used to catch/clean debris/mud until it fills with accumulated debris/mud. When second debris catcher 1800 fills with accumulated debris/mud, then it can be flushed or cleaned as described below.

Switching to Catching Debris Contained In Fluid Source A Via First Debris Catcher, While Simultaneously Using Fluid Source A to Clean/Flush Second Debris Catcher Eventually second debris catcher 1800 will become substantially filled with debris from fluid A flowing through it. Second debris catcher 1800 can be cleaned or flushed of such debris.

Figure 9:
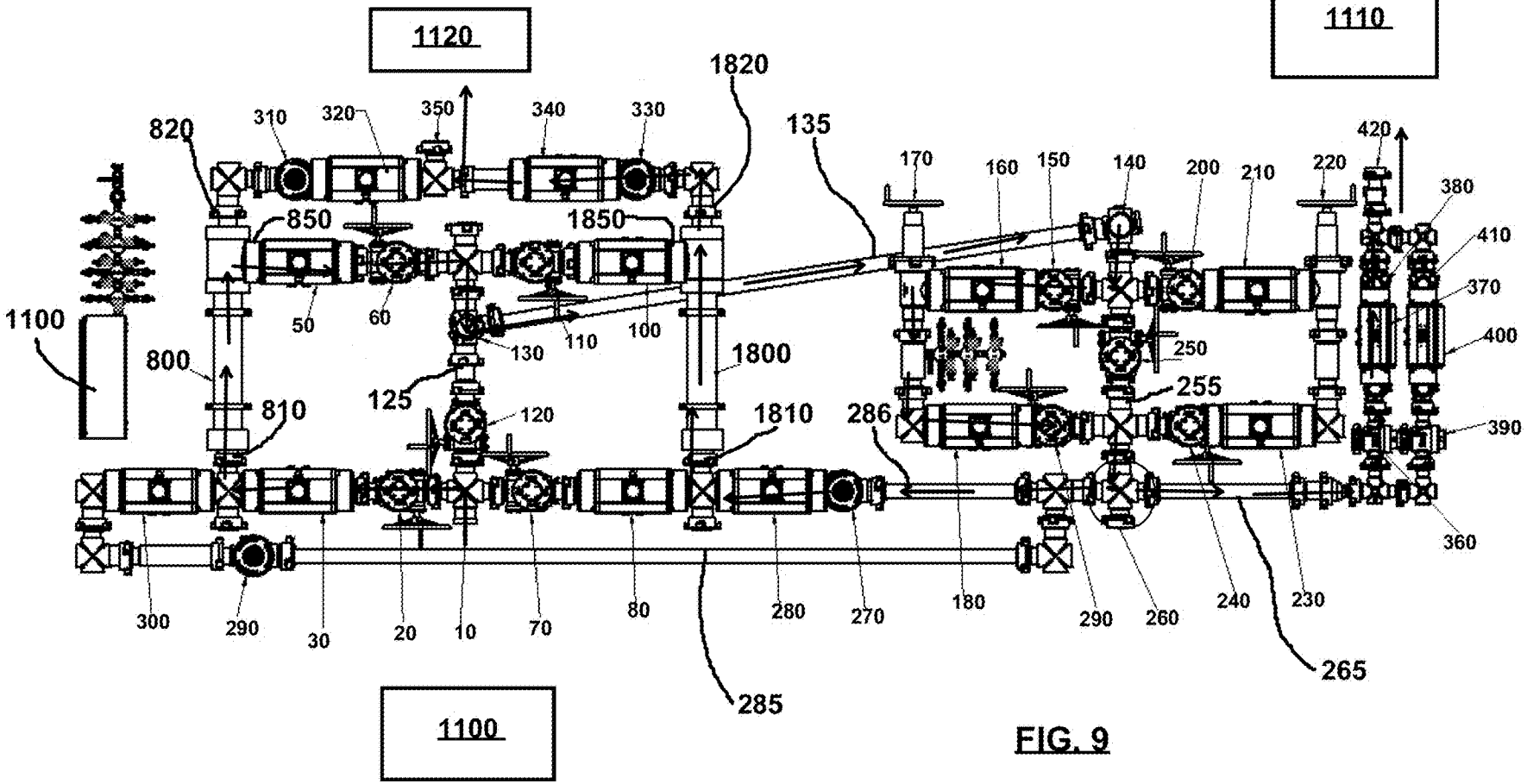
FIG. 9 is the piping layout of FIG. 5 schematically indicating the second or right hand debris catcher being flushed/cleaned while the first or left hand debris catcher is catching flow of fluid passing therethrough.

In one embodiment second debris catcher 0800 can be cleaned or flushed of debris without disrupting the flow of fluid stream A into apparatus 5. FIG. 9 is the piping layout of FIG. 5 schematically indicating the right hand debris catcher being flushed/cleaned while the left hand debris catcher is catching flow of fluid passing therethrough. FIG. 13 is a simplified flow diagram of the method and apparatus as shown in FIG. 9 (with redundant valving omitted for simplicity).

In one embodiment second debris catcher 1800 can be cleaned or flushed of debris while first debris catcher 800 simultaneously catches debris from fluid stream A.

In one embodiment the fluid stream exiting first debris catcher 800 can be used to flush or clean second catcher 1800 while first debris catcher 800 simultaneously catches debris from fluid stream A.

Upon detection of second debris catcher 1800 becoming filled (for example by measuring an increase of differential pressure over a target amount, or other decision), the flow of fluid stream A to apparatus 5 (via inlet 10) does not need to be stopped to flush/clean the debris located inside second debris catcher 1800.

In one embodiment, to flush/clean a now full second debris catcher 1800, flow of fluid stream A from inlet 10 is diverted from second debris catcher 1800 to first debris catcher 800 so that first debris catcher 800 now catches debris from fluid stream A. This can be done by controller 1000 opening and closing various valves to that flow from fluid stream A starting at inlet 10 follows flow path 2200. However, part of the fluid stream A exiting first debris catcher 800 can be used to flush or clean second debris catcher 1800. In this embodiment the apparatus 5 can be switched from flow path 2100 (schematically shown in FIG. 7) to flow path 2000 (schematically shown in FIG. 6). Such flushing or cleaning of second debris catcher 1800 can be performed while cleaned fluid from fluid stream A is still output at clean fluid output 420 so that this output can provide a continuous stream of cleaned fluid from fluid stream A. At diverting component 260, part of the fluid stream A leaving first debris catcher 800 can be diverted to clean or flush second debris catcher 1800, while the remaining portion of the fluid stream leaving first debris catcher 800 leaves flows through valve 360, valve 370, and valve 380 and exits the system 5 through component 420 and can be used in an oilfield process such as drilling or well fracturing as schematically indicated by box 1110 (e.g., flow path schematically indicated by arrows 570, 572, 574, 576, 578, and 580).

The part of the fluid stream leaving first debris catcher 800 that is diverted to second debris catcher 1800 is diverted by opening valve 280 causing fluid to flow through pipe 286 through valve 270, valve 280, and into second debris catcher 1800 (at inlet 1810), flowing through second debris catcher 1800 (and exiting at outlet 1820), to valve 330, valve 340, and finally exiting system 5 via outlet or exit component 350 (e.g., flow path schematically indicated by arrows 570, 572, 574, 576, 578, and 580). Here, the fluid passing through second debris catcher 1800 is fluid from fluid stream A but after such fluid has previously passed through first debris catcher 800 (exiting this first debris catcher 800 at outlet 850). In this manner debris/dirt can be cleaned/caught from fluid stream A while simultaneously the fluid from fluid stream A (after leaving first debris catcher 800) can clean/flush out second debris catcher 1800.

While flowing through flow path 2000, valve 20 and valve 30 are open to allow fluid flow and debris to be captured by first debris catcher 800. Upon verification of the valves open, valve 80 and valve 100 are closed.

Flow continues through flow path 2000 (using first debris catcher 800) of the debris catcher section.

In order to flush the debris captured inside second debris catcher 1800, valve 280 is opened allowing flow from diverting component 260 of the pressure/flow control section through pipe 288 and into inlet 1810 of second debris catcher 1800 to flush out any debris inside this unit leaving debris outlet 1820. Valve 340 is opened to release the pressure trapped in second debris catcher 1800 pushing the captured debris through outlet 1820 and exiting exit component 350, thereby exiting the system 5 to a debris/dirt processing or waste unit 1120. If additional flow is required to second debris catcher 1800 to flush out its accumulated debris, valve 370 of the pressure/flow control section can be closed to divert the entire flow leaving choke valve 170 (from flow path 2000) to the inlet 1810 of second debris catcher 1800.

Even after second debris catcher 1800 is cleaned or flushed as described above, first debris catcher 800 can continued to be used to catch/clean debris/mud until it fills with accumulated debris/mud. When first debris catcher 800 fills with accumulated debris/mud, then it can be flushed or cleaned as described above.

In the above manner first 800 and second 1800 debris catchers can be alternatively used to clean debris/dirt from stream A while the other is being flushed with fluid that has been cleaned from stream A.

Paired Manual And Automatic Valving

In various embodiments a manual valve can be paired with its sister control valve to provide a fallback safety condition if the control valve fails. Under normal operating conditions each of the manual valves are in an open conditions thereby allowing controller 1100 to control flow through the system 5 by opening and closing selected sets of control valves. The following is a listing of the paired manual/control valves shown in one embodiment. Such pairing is a providing for safety concerns but is not required by system 5.

Valves 290/300, 20/30, 70/80, 60/50, 110/100, 310,320, 330/340, 270/280, 150/160, 190/180, 200/210, 240/230, 360/370, and 390/400.

Alternate Flow Paths

In one embodiment, alternate flow path(s) are provided for certain portions of the system are controlled by a plurality of valves.

For example, in FIG. 12 an alternate flow path is possible to the flow path schematically indicated by flow arrows 654, 656, and 658, wherein valve 370 can be closed by controller 1000 and valve 400 opened by controller 1000. In this alternate flow path valve 400 would take the place of valve 370 for flow through the system thereby allowing valve 370 to be serviced while still using the method and apparatus.

As another example, in FIG. 12 an alternate flow path is possible to the flow path schematically indicated by flow arrows 616, 618, and 6620, wherein valve 160 and/or 180 can be closed by controller 1000 and valves 210 and 230 opened by controller 1000. In this alternate flow path pressure regulated valve 220 would take the place of pressure regulated valve 170 for flow through the system thereby allowing valve 170 to be serviced while still using the method and apparatus.

It is to be understood that the invention is not to be limited or restricted to the specific examples or embodiments described herein, which are intended to assist a person skilled in the art in practicing the invention. For example, the number of fluids to be mixed, the number of inlets, the number of outlets, the number of spill over plates, and the number of chambers may vary according to the desired results of a particular application. Also, the dimensions of the various components of the multi-chamber manifold may be scaled to achieve the desired results of a particular application. Accordingly, numerous changes may be made to the details of procedures for accomplishing the desired results. These and other similar modifications will readily suggest themselves to those skilled in the art, and are intended to be encompassed within the spirit of the present invention disclosed herein and the scope of the appended claims.

The following is a list of reference numerals:

LIST FOR REFERENCE NUMERALS (Ref No.) (Description)

5 method and apparatus

10 inlet for well fluids to be treated (e.g., 4-way connector)
20 valve
30 valve
40 left hand debris catcher
50 valve
60 valve
70 valve
80 valve
90 right hand debris catcher
100 valve
110 valve
120 valve
125 by-pass line
130 T-component (possibly a swivel T)
135 pipe
140 T-component (possibly a swivel T)
150 valve
160 valve
170 pressure/flow control valve (choke)
180 valve
190 valve
200 valve
210 valve
220 pressure/flow control valve (choke)
230 valve
240 valve
250 valve
255 by-pass line
260 diverter (e.g., 4-way connector)
265 line/pipe
266 line/pipe
267 line/pipe
270 valve
280 valve
285 line/pipe
286 line/pipe
287 line/pipe
290 valve
300 valve
310 valve
320 valve
330 valve
340 valve
350 exit component
360 valve
370 valve
380 valve
390 valve
400 valve
410 valve
420 flushing fluid outlet
500 arrow
502 arrow
504 arrow
506 arrow
508 arrow
510 arrow
512 arrow
514 arrow
516 arrow
518 arrow
520 arrow
522 arrow
550 arrow
552 arrow
554 arrow
556 arrow
558 arrow
560 arrow
570 arrow
572 arrow
574 arrow
576 arrow
578 arrow
580 arrow
600 arrow
602 arrow
604 arrow
606 arrow
608 arrow
610 arrow
612 arrow
614 arrow
616 arrow
618 arrow
620 arrow
622 arrow
650 arrow
652 arrow
654 arrow
656 arrow
658 arrow
660 arrow
670 arrow
672 arrow
674 arrow
676 arrow
678 arrow
680 arrow
800 debris catcher
804 longitudinal axis
808 bore or interior
810 first end
812 arrow
820 second end
822 arrow
824 flushing/cleaning line
830 shell
850 outlet
852 arrow
900 perforated tube
904 longitudinal axis
908 bore or interior
910 first end
912 arrow
916 length
918 length
920 second end
922 arrow
930 shell
930 plurality of openings or perforations
932 plurality of arrows
950 annular gap between exterior of perforated tube and interior of shell of debris catcher
952 arrow
1000 controller
1080 skid
1800 debris catcher
1804 longitudinal axis
1808 bore or interior
1810 first end
1812 arrow
1820 second end

1822 arrow
1824 flushing/cleaning line
1830 shell
1850 outlet
1852 arrow
2000 fluid flow path
2100 fluid flow path
2200 fluid flow path All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A debris catcher and choke system for receiving a pressurized fluid stream from wellbore operations comprising:

(a) a first debris catcher having:
- (i) a first tubular housing having first and second ends and an interior bore spanning between the first and second ends of the first tubular housing,
- (i) an inlet at the first end of the first tubular housing,
- (ii) a first outlet located between the first and second ends of the first tubular housing,
- (iii) a second outlet at the second end of the first tubular housing,
- (iv) a first strainer located inside the interior bore of the first tubular housing, the first strainer having a first cylindrical shell and a shell interior bore, the first strainer shell creating a first annular space between the first strainer shell and the first cylindrical shell;

(b) a second debris catcher having:
- (i) a second tubular housing having first and second ends and an interior bore spanning between the first and second ends of the second tubular housing,
- (i) an inlet at the first end of the second tubular housing,
- (ii) a first outlet located between the first and second ends of the second tubular housing,
- (iii) a second outlet at the second end of the second tubular housing,
- (iv) a second strainer located inside the interior bore of the second tubular housing, the second strainer having a second cylindrical shell with first and second ends and a shell interior bore, the second strainer shell creating a second annular space between the second strainer shell and the second cylindrical shell;

(c) a first choke valve selectively connectable by a controller to the first and second debris catchers in each of the following operable states regarding the received fluid stream:
- (i) downstream of the first outlet of the first tubular housing
  - without being upstream of the first inlet of the first tubular housing, and further
  - without being upstream of the first inlet of the second tubular housing,
- (ii) downstream of the first outlet of the second tubular housing
  - without being upstream of the first inlet of the first tubular housing, and further
  - without being upstream of the first inlet of the second tubular housing,
- (iii) downstream of the first outlet of first tubular housing and
  - upstream of the first inlet of the second tubular housing, without being upstream of the first inlet of the first tubular housing, and
- (iv) downstream of the first outlet of second tubular housing and
  - upstream of the first inlet of the first tubular housing, without being upstream of the first inlet of the second tubular housing;

(d) wherein, the first debris catcher, second debris catcher, and first choke valve are mounted on a skid, and wherein the pressurized fluid stream is the sole source of flow for each of the operable states.

2. The system of claim 1, wherein the controller is additionally operably connected to a plurality of valves such to selectively open or close various of the plurality of valves, wherein the controller's selective opening or closing of each of the plurality of valves is performed independent of the controllers selective opening or closing of the remaining of the plurality of valves.

3. The system of claim 1, wherein in the operable state of (c)(iv)
- a stream of fluid leaving the first choke valve
- is split into first and second partial streams,
  - the first partial stream being sent to the first inlet of the first tubular housing, and
  - the second partial stream being sent for use in the wellbore operations.

4. The system of claim 3, wherein the plurality of valves are control valves.

5. The system of claim 1, wherein in the operable state (c)(iii)
- a stream of fluid leaving the first choke valve
- is split into first and second partial streams,
  - the first partial stream being sent to the first inlet of the second tubular housing, and
  - the second partial stream being sent for use in wellbore operations.

6. The system of claim 1, wherein in the operable state (c)(iii)
- a stream of fluid leaving the first choke valve
- is split into first and second partial streams,
  - the first partial stream being sent to the first inlet of the second tubular housing
    - causing a flushing or cleaning accumulated debris or solids
    - which exit the second outlet of the second tubular housing, and
  - the second partial stream being sent for use in the wellbore operations.

7. The system of claim 1, wherein in the operable state (c)(iv)
- a stream of fluid leaving the first choke valve
- is split into first and second partial streams,
  - the first partial stream being sent to the first inlet of the first tubular housing
    - causing a flushing or cleaning accumulated debris or solids which exit the second outlet of the first tubular housing, and the second partial stream being sent for use in the wellbore operations.

8. The system of claim 1, wherein, at a time when the first choke valve is not fluidly connected to either the first or second debris catcher regarding the received fluid stream, the controller selectively connects a second choke valve to the first or second debris catchers, in one of the following operable states regarding the received fluid stream:

(i) downstream of the first outlet of the first tubular housing without being upstream of the first inlet of the first tubular housing, and further without being upstream of the first inlet of the second tubular housing, (ii) downstream of the first outlet of second tubular housing without being upstream of the first inlet of the first tubular housing, and further without being upstream of the first inlet of the second tubular housing, (iii) downstream of the first outlet of first tubular housing and upstream of the first inlet of the second tubular housing, without being upstream of the first inlet of the first tubular housing, and (iv) downstream of the first outlet of second tubular housing and upstream of the first inlet of the first tubular housing, without being upstream of the first inlet of the second tubular housing;

(d) wherein, the first debris catcher, second debris catcher, choke valve, and controller are mounted on a skid, and wherein a the pressurized fluid stream is the sole source of flow for each of the listed states in "c".

9. The system of claim 1, wherein the first choke valve selectively connectable by a controller to the first and second debris catchers in each of the following operable states regarding the received fluid stream:

(i) downstream of the first outlet of the first tubular housing and second end of the first strainer without being upstream of the first inlet of the first tubular housing, and further without being upstream of the first inlet of the second tubular housing, (ii) downstream of the first outlet of second tubular housing and second end of the second strainer without being upstream of the first inlet of the first tubular housing, and further without being upstream of the first inlet of the second tubular housing, (iii) downstream of the first outlet of the first tubular housing and second end of the first strainer and upstream of the first inlet of the second tubular housing and first end of the second strainer, without being upstream of the first inlet of the first tubular housing, and (iv) downstream of the first outlet of second tubular housing and second end of the second strainer upstream of the first inlet of the first tubular housing and first end of the first strainer, without being upstream of the first inlet of the second tubular housing.

10. A method of cleaning an oilfield fluid stream comprising the steps of:

(a) providing an automated debris catching system, the debris catching system having:

(1) a first debris catcher having:

(i) a first tubular housing having first and second ends and an interior bore spanning between the first and second ends of the first tubular housing, (i) an inlet at the first end of the first tubular housing, (ii) a first outlet located between the first and second ends of the first tubular housing, (iii) a second outlet at the second end of the first tubular housing, (iv) a first strainer located inside the interior bore of the first tubular housing, the first strainer having a first cylindrical shell with first and second ends and a shell interior bore, the first strainer shell creating a first annular space between the first strainer shell and the first cylindrical shell;

(2) a selectably operable second debris catcher having:

(i) a second tubular housing having first and second ends and an interior bore spanning between the first and second ends of the second tubular housing, (i) an inlet at the first end of the second tubular housing, (ii) a first outlet located between the first and second ends of the second tubular housing, (iii) a second outlet at the second end of the second tubular housing, (iv) a second strainer located inside the interior bore of the second tubular housing, the second strainer having a second cylindrical shell with first and second ends and a shell interior bore spanning, the second strainer shell creating a second annular space between the second strainer shell and the second cylindrical shell;

(3) a first choke valve selectively connectable by a controller to the first and second debris catchers in each of the following operable states regarding the received fluid stream:

(i) downstream of the first outlet of the first tubular housing without being upstream of the first inlet of the first tubular housing, and further without being upstream of the first inlet of the second tubular housing, (ii) downstream of the first outlet of second tubular housing without being upstream of the first inlet of the first tubular housing, and further without being upstream of the first inlet of the second tubular housing, (iii) downstream of the first outlet of first tubular housing and upstream of the first inlet of the second tubular housing, without being upstream of the first inlet of the first tubular housing, and (iv) downstream of the first outlet of second tubular housing and upstream of the first inlet of the first tubular housing, without being upstream of the first inlet of the second tubular housing;

(4) wherein, the first debris catcher, second debris catcher, and first choke are mounted on a skid, and wherein a the pressurized fluid stream is the sole source of flow for each of the operable states;

(b) the first debris catcher being in a stream cleaning mode, wherein it receives the oilfield stream in the inlet of the first tubular housing and the stream leaving the first outlet of the first tubular housing has solids removed, and wherein the choke valve is operably connected to the controller regulating a backpressure to the first outlet of the first tubular housing;

(c) after step "b" the oilfield stream leaving the automated debris catching system for use in wellbore operations;

(d) during step "b" the controller monitoring a first physical parameter regarding the oilfield stream and, if the first physical parameter satisfies a predetermined value, the controller placing:

(i) the second debris catcher in a stream cleaning mode, wherein, the second debris catcher receives the oilfield stream in the inlet of the second tubular housing and the oilfield stream leaving the first outlet of the second tubular housing has solids removed, and wherein the choke valve is operably connected to the controller regulating a backpressure to the first outlet of the second tubular housing; and further (ii) the first debris catcher in a flushing mode, wherein at least part of the stream leaving the first outlet of the second tubular housing is directed into the first inlet of the first tubular housing and then exiting the second outlet of the first tubular housing along with accumulated solids from the first debris catcher thereby flushing the first debris catcher.

11. The method of claim 10, wherein in step "d", the controller monitoring a second physical parameter regarding the oilfield stream in the first debris catcher and, if the second physical parameter satisfies a predetermined value, the controller placing the first debris catcher in a cleaning mode.

12. The method of claim 11, wherein in step "d" the second physical parameter is selected from the group consisting of pressure, resistance to flow, flow rate, volume of flow, time period of flow, and combinations of any of the foregoing.

13. The method of claim 10, wherein in step "d", the controller monitoring a third physical parameter regarding the oilfield stream in the second debris catcher and, if the third physical parameter satisfies a predetermined value, the controller placing the second debris catcher in a flushing mode.

14. The method of claim 13, wherein in step "d" the third physical parameter is selected from the group consisting of pressure, resistance to flow, flow rate, volume of flow, time period of flow, and combinations of any of the foregoing.

15. The method of claim 10, wherein the controller monitoring a fourth physical parameter regarding the oilfield stream in the first choke valve and, if the fourth physical parameter satisfies a predetermined value, the controller switching stream flow from the first choke valve to the second choke valve and a second choke valve regulates back pressure.

16. The method of claim 10, wherein in step "d" the first physical parameter is selected from the group consisting of pressure, resistance to flow, flow rate, volume of flow, time period of flow, and combinations of any of the foregoing.

17. The method of claim 10, wherein in step "d" the fourth physical parameter is selected from the group consisting of pressure, resistance to flow, flow rate, volume of flow, time period of flow, and combinations of any of the foregoing.

* * * * *